US006224055B1

(12) United States Patent
Walker et al.

(10) Patent No.: US 6,224,055 B1
(45) Date of Patent: May 1, 2001

(54) TICKET FOR INSTANT LOTTERY GAME AND METHOD OF PLAYING SAME

(75) Inventors: Jay S. Walker, Ridgefield; James A. Jorasch; Stephen C. Tulley, both of Stamford, all of CT (US)

(73) Assignee: Walker Digital, LLC, Stamford, CT (US)

( * ) Notice: Subject to any disclaimer, the term of this patent is extended or adjusted under 35 U.S.C. 154(b) by 0 days.

(21) Appl. No.: 09/434,270

(22) Filed: Nov. 5, 1999

Related U.S. Application Data

(62) Division of application No. 09/001,901, filed on Dec. 31, 1997.

(51) Int. Cl.[7] ..... A63F 3/06

(52) U.S. Cl. ..... 273/139; 283/901; 283/903

(58) Field of Search ..... 273/139, 138.1, 273/269; 283/901, 903

(56) References Cited

U.S. PATENT DOCUMENTS

| | | | | |
|---|---|---|---|---|
| 4,191,376 | | 3/1980 | Goldman et al. | 273/139 |
| 5,092,598 | * | 3/1992 | Kamille | 273/139 |
| 5,118,109 | | 6/1992 | Gumina | 273/139 |
| 5,158,293 | | 10/1992 | Mullins | 273/139 |
| 5,193,815 | | 3/1993 | Pollard | 273/269 |
| 5,265,880 | | 11/1993 | Maksymec | 273/269 |
| 5,294,120 | | 3/1994 | Schultz | 463/13 |

(List continued on next page.)

FOREIGN PATENT DOCUMENTS

2075918 * 11/1981 (GB) ..... 283/903

OTHER PUBLICATIONS

John Grochowski, "Explaining Video Poker: How The Cards are Dealt", Chicago Sun–Times, Jun. 10, 1994, p. 30.
Scott Dyer, "Lottery Unveils Games Similar to Video Poker", The Advocate (Baton Rouge, La.), May 28, 1996 p. 4A.
Charles E. Beggs, "People are Getting Bored With Video Poker", The Bulletin (Bend, OR), Jun. 14, 1996, p. B8.

(List continued on next page.)

*Primary Examiner*—Benjamin H. Layno
(74) *Attorney, Agent, or Firm*—Steven M. Santisi; Nathaniel Levin

(57) ABSTRACT

A ticket for an instant lottery game and method for playing the same is disclosed. As described in one aspect of the disclosure, a ticket for an instant lottery game simulates computerized video poker. The ticket comprises an initial hand of cards imprinted on the ticket, wherein the initial hand is normally hidden under a corresponding alterable area so that when the alterable area corresponding to the initial hand is altered, the initial hand is revealed. The ticket also includes a plurality of strategies for the game each imprinted on the ticket, wherein each strategy is related to the initial hand, wherein the strategies are those that are most likely to result in a player achieving a favorable outcome for the game, and wherein each strategy is normally hidden under a corresponding alterable area so that when an alterable area corresponding to one of the plurality of strategies is altered, the strategy corresponding thereto is revealed. The ticket also includes a plurality of final hands for the game imprinted on the ticket, wherein each of the plurality of final hands is associated with a corresponding one of the plurality of strategies, and wherein each of the plurality of final hands is normally hidden under a corresponding alterable area. In this way, when a strategy is selected by a player and the alterable area corresponding thereto is altered, the final hand for the game is revealed.

29 Claims, 24 Drawing Sheets

U.S. PATENT DOCUMENTS

| | | | | |
|---|---|---|---|---|
| 5,407,199 | | 4/1995 | Gumina | 273/139 |
| 5,451,052 | | 9/1995 | Behm et al. | 273/139 |
| 5,475,205 | | 12/1995 | Behm et al. | 235/375 |
| 5,531,448 | | 7/1996 | Moody | 273/292 |
| 5,653,635 | | 8/1997 | Breeding | 463/11 |
| 5,690,367 | | 11/1997 | Fromer | 283/94 |
| 5,788,237 | * | 8/1998 | Fults et al. | 273/269 |
| 5,835,576 | | 10/1998 | Katz | 379/93.13 |
| 5,944,354 | | 8/1999 | Feola | 283/67 |

OTHER PUBLICATIONS

John Grochowski, "Pick Five Shuffles Video Poker", Chicago Sun–Times, Sep. 21, 1997, p. 22.

Brochure: "We're Putting our Cards on the Table," Webcraft Games, Inc., Undated.

* cited by examiner

300

| | POSSIBLE FINAL HANDS 305 | LOTTERY PAYOUT 310 | LOTTERY EXPECTED VALUE 320 |
|---|---|---|---|
| A | ROYAL FLUSH | $800 | $0.0199 |
| B | STRAIGHT FLUSH | $50 | $0.0053 |
| C | FOUR OF A KIND | $25 | $0.0591 |
| D | FULL HOUSE | $9 | $0.1037 |
| E | FLUSH | $6 | $0.0648 |
| F | STRAIGHT | $4 | $0.0454 |
| G | THREE OF A KIND | $2 | $0.1490 |
| H | TWO PAIR | $1 | $0.1294 |
| I | PAIR JACKS OR BETTER | $1 | $0.2145 |
| J | HIGH CARD | $0 | $0.0000 |
| K | TOTAL | N/A | $0.7910 |

FIG. 3A

| | FINAL HAND 335 | PAYOUT 340 | DRAW TWO CARDS TO THE A-Q-K 330A | | DRAW THREE CARDS TO THE K-Q 330B | | DRAW THREE CARDS TO THE A-10 330C | |
|---|---|---|---|---|---|---|---|---|
| | | | DRAWS 350 | PAYOUT 355 | DRAWS 360 | PAYOUT 365 | DRAWS 370 | PAYOUT 375 |
| A | | | | | | | | |
| B | ROYAL FLUSH | $800 | 0 | $0 | 0 | $0 | 1 | $800 |
| C | STRAIGHT FLUSH | $50 | 0 | $0 | 0 | $0 | 0 | $0 |
| D | FOUR OF A KIND | $25 | 0 | $0 | 2 | $50 | 2 | $50 |
| E | FULL HOUSE | $9 | 0 | $0 | 18 | $162 | 18 | $162 |
| F | FLUSH | $6 | 0 | $0 | 0 | $0 | 164 | $984 |
| G | STRAIGHT | $4 | 12 | $48 | 84 | $336 | 35 | $140 |
| H | THREE OF A KIND | $2 | 9 | $18 | 281 | $562 | 281 | $562 |
| I | TWO PAIR | $1 | 27 | $27 | 711 | $711 | 711 | $711 |
| J | PAIR JACKS OR BETTER | $1 | 348 | $348 | 4,914 | $4,914 | 2,739 | $2,739 |
| K | HIGH CARD | $0 | 685 | $0 | 10,205 | $0 | 12,264 | $0 |
| L | TOTAL | N/A | 1,081 | $441 | 16,215 | $6,735 | 16,215 | $6,148 |
| | EXPECTED VALUE | - | - | $0.41 | - | $0.42 | - | $0.38 |

PAYOUT INFORMATION

| | |
|---|---|
| ROYAL FLUSH | $800 |
| STRAIGHT FLUSH | $50 |
| FOUR OF A KIND | $25 |
| FULL HOUSE | $9 |
| FLUSH | $6 |
| STRAIGHT | $4 |
| THREE OF A KIND | $2 |
| TWO PAIR | $1 |
| PAIR JACKS OR BETTER | $1 |

150G

TO CLAIM YOUR PRIZE:

Royal Flush wins can be claimed by presenting a winning ticket at High Tier Claim Centers or Lottery HQ.

All other winning tickets can be redeemed at any Lottery Retailer location.

All cash Prizes are redeemable up to one full year from announced end of game. Ask retailer for details.

Minors prohibited from ticket purchases.

Persons altering ticket subject to prosecution.

Average chance of winning a prize is 1:4.36

150H

150I

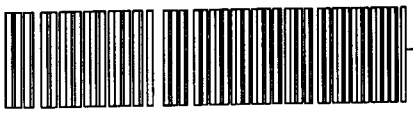

FIG. 3C

| | | | | | | | |
|---|---|---|---|---|---|---|---|
| 5s | WILD! | 2d | 5d | Qs | 6h | 8s | Kd |
| Qc | 8c | 9s | Jd | 7s | As | 10h | 9c |
| 4s | 3s | 7d | 4d | 3c | 5h | 2c | 6d |
| 10c | 2s | Qd | Ac | 7h | 2h | Ks | 3d |
| Jh | Kh | 9h | 4h | 3h | 8d | 6c | 8h |
| 9d | 4c | Js | 10s | 5c | Jc | Ah | 7c |

| | | | | | | | |
|---|---|---|---|---|---|---|---|
| Kd | 8s | 6h | Qs | 5d | 2d | WILD! | 5s |
| 9c | 10h | As | 7s | Jd | 9s | 8c | Qc |
| 6d | 2c | 5h | 3c | 4d | 7d | 3s | 4s |
| 3d | Ks | 2h | 7h | Ac | Qd | 2s | 10c |
| 8h | 6c | 8d | 3h | 4h | 9h | Kh | Jh |
| 7c | Ah | Jc | 5c | 10s | Js | 4c | 9d |

3150

3100

SCRATCH OFF

B-I-N-G-O

3105

YOUR CARD 3110A

| B | I | N | G | O |
|---|---|---|---|---|
| 4 | 16 | 33 | 46 | 63 |
| 5 | 19 | 35 | 49 | 65 |
| 9 | 20 | FREE | 50 | 66 |
| 10 | 22 | 44 | 53 | 71 |
| 15 | 23 | 45 | 57 | 74 |

3110

INSTRUCTIONS 3150A

Draw your own bingo numbers by scratching off the spots below. When a number matches a number from your card, scratch that spot on your card. Stop scratching when you get five in a row, either vertically, horizontally or diagonally.

3140

| | | | | |
|---|---|---|---|---|
| 23 | 53 | 1 | 45 | 16 |
| 8 | 11 | 13 | 24 | 29 |
| 15 | 27 | 43 | 44 | 7 |
| 57 | 9 | 17 | 22 | 54 |
| 71 | 73 | 19 | 55 | 53 |
| 74 | 70 | 46 | 49 | 6 |
| 21 | 68 | 2 | 18 | 14 |
| 67 | 69 | 34 | 72 | 5 |
| 28 | 35 | 48 | 23 | 47 |
| 4 | 66 | 20 | 52 | 36 |
| 51 | 50 | 61 | 33 | 56 |
| 37 | 25 | 39 | 10 | 26 |
| 75 | 60 | 59 | 30 | 38 |
| 64 | 12 | 41 | 3 | 65 |
| 32 | 52 | 31 | 62 | 40 |

3140C

See reverse side for prize amounts and rules

FIG. 10B

PAYOUT INFORMATION

3150B

| | |
|---|---|
| 5 SCRATCHES | **$10,000** |
| 6 SCRATCHES | **$5,000** |
| 7 SCRATCHES | **$3,000** |
| 8 SCRATCHES | **$1,000** |
| 9 SCRATCHES | **$500** |

3150C

TO CLAIM YOUR PRIZE:

Prizes Greater than $50 can be claimed by presenting a winning ticket at High Tier Claim Centers or Lottery HQ.

All other winning tickets can be redeemed at any Lottery Retailer location.

All cash Prizes are redeemable up to one full year from announced end of game. Ask retailer for details.

Minors prohibited from ticket purchases.

Persons altering ticket subject to prosecution.

3150D

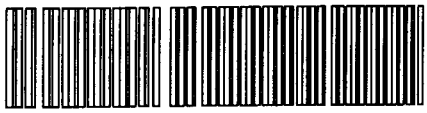

FIG. 10D

1100

| | POSSIBLE FINAL HANDS 1105 | FREQUENCY 1110 | VIDEO POKER PAYOUT 1115 | VIDEO POKER EXPECTED VALUE 1120 |
|---|---|---|---|---|
| A | ROYAL FLUSH | 0.0000249 | $800 | $0.0199 |
| B | STRAIGHT FLUSH | 0.0001053 | $50 | $0.0053 |
| C | FOUR OF A KIND | 0.0023640 | $25 | $0.0591 |
| D | FULL HOUSE | 0.0115200 | $9 | $0.1037 |
| E | FLUSH | 0.0108000 | $6 | $0.0648 |
| F | STRAIGHT | 0.0113500 | $4 | $0.0454 |
| G | THREE OF A KIND | 0.0744900 | $3 | $0.2235 |
| H | TWO PAIR | 0.1294000 | $2 | $0.2588 |
| I | PAIR JACKS OR BETTER | 0.2145000 | $1 | $0.2145 |
| J | HIGH CARD | 0.5456000 | $0 | $0.0000 |
| K | TOTAL | 1.0001542 | N/A | $0.9949 |

PRIOR ART

FIG. 11

TICKET FOR INSTANT LOTTERY GAME AND METHOD OF PLAYING SAME

CROSS-REFERENCE TO RELATED APPLICATIONS

This application is a divisional of U.S. patent application Ser. No. 09/001,901 entitled "TICKET FOR INSTANT LOTTERY GAME AND METHOD OF PLAYING SAME" filed in the name of Jay S. Walker, James A. Jorasch, and Stephen C. Tulley on Dec. 31, 1997.

FIELD OF THE INVENTION

The present invention relates to a ticket for an instant lottery game and a method for playing the same.

BACKGROUND OF THE INVENTION

Instant lottery games are well known and widely practiced. Indeed, they represent a $15 billion industry in the United States. A typical instant lottery game is implemented using a ticket, which includes a background section and a play section. The background section usually includes the name of the game, instructions for playing the game, information describing winning combinations, and associated payouts that may be won by a player. It may also include other miscellaneous information such as the price of the ticket and the name of the entity sponsoring the game.

The play section of the ticket usually includes one or more play areas, each of which contains outcome indicia. The outcome indicia are typically compared to the winning combinations to determine whether the ticket is a winner, as is described in more detail below. The outcome indicia are generally obscured from the view of players and vendors selling the tickets by an alterable opaque covering surface, such as latex.

The background and play sections of the ticket often are designed in accordance with a theme of the instant lottery game. Attributing the theme to the game is intended to make the game appear more interesting and exciting to the players. To this end, the background section generally is designed to reflect the theme and is made to be colorful and fanciful. The outcome indicia and the alterable opaque covering surface of the play section also are usually designed in accordance with the theme.

For example, a theme for an instant lottery game may be slot machines. In this case, the background of the ticket may include a name such as "LUCKY SEVENS" printed in a fanciful font. It may also include a picture or symbol of a slot machine. The set of possible outcome indicia might include symbols that are customarily used by slot machines, such as cherries, lemons, oranges, and bars. Other popular themes include blackjack, bingo, monopoly, or general money themes like "break the bank," or "road to riches."

Regardless of the game theme and the particular design of the ticket, instant lottery games are generally played in the same manner. More specifically, to play a typical game, a player removes the alterable opaque covering surface from a play area of the ticket to reveal the outcome indicia. This may be done, for example, using a coin or other suitable means to scratch off a covering surface such as latex. The outcome indicia themselves often indicate the payout. Typically, six outcome indicia are revealed, with the player winning a payout if three of the outcome indicia match each other. If three matching outcome indicia are not present, the ticket is a loser and there is no payout to the player.

Instant lottery games can be classified into one of two categories—that is, standard games and probability games.

The standard games category include non-probability games in which a ticket, at the time it is sold to a player, is predetermined as a winner or a loser. Thus, with standard, non-probability instant lottery games, every ticket is not a potential winner.

The second category of instant lottery games are probability games in which every ticket is a potential winner. One such probability game is described in U.S. Pat. No. 5,475,205, issued to Behm et al. As disclosed in that patent, a ticket for such a probability game includes multiple play areas. Each play area contains outcome indicia indicative of a dollar amount. The outcome indicia are covered by a removable latex material.

To play this probability game, a player removes the latex material from a predetermined number of play areas, which is less than the total number of play areas. If the revealed outcome indicia match a predetermined combination, then the ticket is a winner and the player can redeem it for a payout. In this case, the payout is the dollar amount indicated by the outcome indicia. However, if the revealed outcome indicia do not match a predetermined combination, then the player loses the game and the ticket has no redeemable value. The ticket is voided if the player removes the latex from more than the predetermined number of play areas.

The popularity of probability-type instant lottery games with players can be attributed to the fact that, for such probability games, every ticket is a possible winner. The player thus feels as though he has an element of control since he is free to choose those play areas that will be played. If a player has lost the game, he can remove the remaining latex to confirm that at least one winning combination is present on the ticket, which leaves the player with a feeling that the game is fair.

The standard instant lottery games described above suffer from a number of problems. First, the games typically only require that a player remove some of the opaque covering surfaces of a ticket. The player need not make any decisions during the game, even the most basic one concerning which of the play areas will be played. This results in a perception that the games are based on pure luck. Further, these games tend to be simplistic and boring to the players. While the probability games offer an opportunity for the player to make this basic decision, these games still are based on pure luck and do not allow a player to use strategy to improve his chance of achieving a favorable outcome for the game.

Another problem with known instant lottery games is that the amount of time it takes to play such game is usually quite short. In most cases, the player simply purchases a ticket and alters the opaque covering surface. There is no opportunity to ponder game strategies and make decisions based thereon that may affect the outcome and extend the life of the game.

Unlike prior art instant lottery games, video poker is a game that gives a player control to exercise skill by considering game strategies and making decisions based thereon that will affect the outcome of the game. Video poker games, which are generally played in gaming establishments, have become extremely popular and are quite exciting. In fact, they are one of the fastest growing segments of casino revenue.

The basic game of video poker is played on a computerized video poker machine. A player is dealt an initial hand of five cards from a standard deck of fifty-two cards. The five cards are randomly chosen by a computer and displayed to the player on a video screen. With a goal of maximizing the value of his hand, the player decides which cards, if any, to hold. Given the initial hand, the player may decide to hold all five of his cards—i.e., stand. To do this, he presses a button labeled HOLD under each displayed card.

Alternatively, the player may decide to hold only certain of the five cards dealt to him in his initial hand. In this case, the player presses the HOLD button under each card he decides to hold. After the player has decided which cards to hold, he press a button labeled DEAL. This causes the computer to discard the cards that the player has decided not to hold, and replace them with additional cards that are randomly selected from the remaining forty-seven cards of the deck.

After the DEAL button has been pressed, the final hand of the player is evaluated by the computer. If the player's final hand matches a predetermined combination—e.g., a Full House or Three of a Kind, then the player is awarded a payout in the form of either play credits or coins in accordance with a payout table. The payout table is stored in the memory of the computer and is also displayed on the video screen for the player to view. The payout for a particular final hand increases with the value of the hand. Thus, hands with higher poker values are awarded more play credits or coins. For example, very rare poker hands such as a Royal Flush are awarded payouts of 800-to-1 in some game variations.

The payouts for video poker games are typically selected to generate a profit for the game operator. The payouts are multiplied by the frequency (or probability) that a player will receive an associated hand to determine the expected value of the game. FIG. 11 depicts a payout table 1100 for a "Jacks or Better" video poker game. The payout table 1100 includes columns 1105, 1110, 1115, and 1120 and rows A–K. For ease of reference, a particular location within this and other tables herein will be referred to by their column number and row letter. Such locations will be referred to herein as "cells." Cells 1105A–1105J each indicate a final hand that is possible for a player to receive, given an initial set (or hand) of five cards. Cells 1110A–1110J each depict the frequency (or probability) that the player will receive the associated final hand. These frequencies assume that the player is employing strategies that maximize the expected value of each play. Cells 1115A–1115J each indicate a payout (or prize) that the associated final hand will pay if it is received. Cells 1120A–1120J each depict an expected value of the associated final hand, given the associated payout.

The expected value for a cell 1120A–1120J is calculated by multiplying the associated frequency from a cell 1110A–1110J by the associated payout from cell 1115A–1115J, respectively. For example, the expected value for a Royal Flush ($0.0199) is calculated by multiplying the frequency of cell 1110A (0.0000249) by the associated payout ($800) shown in cell 1115A. The total expected value illustrated in cell 1120K ($0.9949) represents the dollar amount returned to the player over an extended period of time. For this particular payout schedule, the player will receive 99.49 cents for each dollar wagered. This payout requires perfect play, however, so many players will receive a few cents less on average. A total expected value of more than $1.00 would represent a video poker machine in which the player had an advantage over the operator thereof. Some games having an expected value of more than $1.00 still can be profitable for the gaming establishment if the majority of players are not playing perfectly.

In addition to the basic game of video poker described above, other variations which include wild cards and jokers are also played, such as "Joker Poker," "Deuces Wild," and "Bonus Poker." Further information on these and other video poker games, payout tables and calculations, and game strategies may be found in Paymar, D., "Video Poker Precision Play," (published by Enchanceware of Las Vegas, Nev.).

The popularity of video poker games may be attributed to the player's ability to exercise an element of skill during the game. More particularly, by deciding which cards to hold from an initial hand, the player makes a decision that directly affects the outcome of the game. Thus, this exercise of an element of skill tends to keep the players interested in the game. Further, the players are also attracted to the potential to receive a high payout, as compared to other casino games, such as craps and blackjack.

However, video poker games have major drawbacks. First, while many variations of such games exist, each variation is computer- and video-based. Thus, the games require complex electronic apparatus, which can be prohibitively expensive. Moreover, video poker games typically can be played only in a controlled gaming environment.

One patent that attempts to combine an instant lottery ticket with a game of poker is U.S. Pat. No. 5,118,109 to Gumina. According to this patent, a player scratches off an area to reveal an initial hand of cards. The ticket includes twenty-five other areas that indicate cards that can be kept from the initial hand. The player draws additional cards from one of the twenty-five areas in an effort to improve the value of his final hand. The result of the game is determined based on this value.

However, the Gumina patent is plagued with problems that likely have resulted in reduced player interest in the game. More specifically, the number of areas from which the player can draw cards is numerous. This leaves the ticket cluttered, confusing, and visually unappealing.

Further, for any given initial poker hand, there are usually only a few reasonable choices of cards to draw in order to optimize the final value of the hand. The ticket disclosed in the Gumina patent presents a player with twenty-five choices. Thus, it is not in the player's best interest to select a majority of the choices because they lessen—rather than increase—the player's chance of optimizing the final value of his hand. To a typical player who is not an expert poker player, this can be discouraging. Even further, due to the confusing nature of the layout of the ticket, a player may accidentally uncover an unintended area. This may leave the player feeling cheated and frustrated.

Still further, the ticket disclosed in the Gumina patent limits the cards that a player can draw. This is because the draw cards include only certain cards from the remainder of the deck from which the initial hand was dealt. Thus, a player does not have any control over the cards that he can draw in order to obtain a desired final hand. For example, if a player decides to draw certain cards in an attempt to obtain a Flush, there is no guarantee that the ticket includes draw cards that would enable him to obtain the Flush.

In view of the above, what is needed in order to increase player interest in instant lottery games is a ticket in which a player is guided to the best choices for him to select and in which he also is given an opportunity to select choices from a universe of choices that are not preselected by the manufacturer of the ticket.

SUMMARY OF THE INVENTION

A first aspect of the present invention is directed toward a ticket for an instant lottery game. The ticket includes an initial configuration section comprising an initial configuration for the game. The ticket also includes a strategy section comprising a plurality of strategies for the game, wherein each strategy is related to the initial configuration. The strategies are those that are most likely to result in a player achieving a favorable outcome for the game. The ticket also includes an outcome section comprising a plurality of outcomes for the game. Each of the plurality of outcomes is associated with a corresponding one of the plurality of strategies. Each of the plurality of outcomes is normally hidden under a corresponding alterable area so that when a strategy is selected by a player and the alterable area corresponding thereto is altered, the outcome for the game is revealed.

A second aspect of this invention is directed to a method for playing an instant lottery game using a ticket. The method comprises the steps of determining an initial configuration for the game from the ticket and selecting a game strategy from a plurality of game strategies on the ticket. Each of the game strategies is based on the initial configuration and the game strategies are those that are most likely to result in a player achieving a favorable outcome for the game. Further, from a plurality of alterable areas on the ticket each associated with a corresponding one of the plurality of game strategies and each corresponding to one of a plurality of outcomes for the game, the method includes the step of altering the alterable area corresponding to the selected game strategy to reveal the corresponding outcome for the game.

A third aspect of the present invention is directed to a ticket for an instant lottery game, wherein the game has game indicia associated therewith. The ticket includes an initial configuration section comprising an initial configuration for the game, wherein the initial configuration represents a subset of the game indicia. The ticket also includes a strategy section comprising a plurality of strategies for the game, wherein each strategy is related to the initial configuration. The strategies are those that are most likely to result in a player achieving a favorable outcome for the game. The ticket also includes an outcome section comprising a plurality of outcome areas, wherein each outcome area is associated with a corresponding one of the plurality of strategies, and wherein each outcome area comprises a plurality of indicia normally hidden under a corresponding alterable area. The plurality of indicia represent a complement of the subset with respect to the game indicia so that when a strategy is selected by a player and a portion of the alterable area corresponding thereto is altered based on the strategy, a predetermined number of the indicia are revealed so that an outcome for the game can be determined.

A fourth aspect of this invention is directed to a method for playing an instant lottery game using a ticket, wherein the game has game indicia associated therewith. The method comprises the steps of determining an initial configuration for the game from the ticket, wherein the initial configuration represents a subset of the game indicia. The method also includes the step of selecting a game strategy from a plurality of game strategies on the ticket, wherein each of the game strategies is based on the initial configuration, and wherein the game strategies are those that are most likely to result in a player achieving a favorable outcome for the game. Further, from a plurality of outcome areas each associated with a corresponding one of the plurality of strategies and each comprising a plurality of indicia representing the complement of the subset with respect to the game indicia and normally hidden under a corresponding alterable area, the method includes the step of altering a portion of the alterable area corresponding to the selected game strategy to reveal certain of the indicia so that an outcome for the game can be determined.

A fifth aspect of the present invention is directed to a ticket for an instant lottery game that simulates computerized video poker. The ticket comprises an initial hand of cards imprinted on the ticket, wherein the initial hand is normally hidden under a corresponding alterable area so that when the alterable area corresponding to the initial hand is altered, the initial hand is revealed. The ticket also includes a plurality of strategies for the game each imprinted on the ticket, wherein each strategy is related to the initial hand, wherein the strategies are those that are most likely to result in a player achieving a favorable outcome for the game, and wherein each strategy is normally hidden under a corresponding alterable area so that when an alterable area corresponding to one of the plurality of strategies is altered, the strategy corresponding thereto is revealed. The ticket also includes a plurality of final hands for the game imprinted on the ticket, wherein each of the plurality of final hands is associated with a corresponding one of the plurality of strategies, and wherein each of the plurality of final hands is normally hidden under a corresponding alterable area. In this way, when a strategy is selected by a player and the alterable area corresponding thereto is altered, the final hand for the game is revealed.

A sixth aspect of the present invention is directed to a ticket for an instant lottery game, wherein the game has game indicia associated therewith. The ticket comprises an initial configuration section comprising a plurality of initial indicia, wherein the initial indicia represent a subset of the game indicia. The ticket also includes an outcome section comprising a plurality of final indicia normally hidden under an alterable area, wherein the final indicia represent a complement of the subset with respect to the game indicia. In this way, when a predetermined number of the final indicia are revealed, an outcome for the game can be determined.

A seventh aspect of this invention is directed to a method for playing an instant lottery game using a ticket, wherein the game has game indicia associated therewith. The method comprises the steps of determining an initial configuration for the game, wherein the initial configuration comprises a plurality of initial indicia representing a subset of the game indicia. The method further includes the step of altering a portion of an alterable covering surface normally hiding final indicia representing the complement of the subset with respect to the game indicia to reveal a predetermined number of the final indicia so that an outcome for the game can be determined.

An eighth aspect of the present invention is directed to a ticket for an instant lottery game, wherein the game has game indicia associated therewith. The ticket comprises an initial configuration section comprising a plurality of first indicia. The ticket also includes an outcome section comprising a plurality of second indicia normally hidden under an alterable area, wherein the second indicia represent each of the game indicia. In this way, when a number of the second indicia are revealed such that the second indicia match the first indicia, a payout to a player of the game can be determined based on the number.

BRIEF DESCRIPTION OF THE DRAWINGS

Representative embodiments of the present invention will be described with reference to the following figures:

FIG. 3A depicts a payout table 300 that may be used with the present invention to determine payouts.

FIG. 3C depicts the reverse side of ticket 100.

FIG. 10B depicts ticket 3100 after the alterable covering surface of the outcome section have been altered.

FIG. 10D depicts the reverse side of ticket 3100.

FIG. 11 depicts a payout table 1100 that is used with conventional computerized video poker games.

DETAILED DESCRIPTION OF THE PREFERRED EMBODIMENTS

Reference is now made to the accompanying Figures for the purpose of describing, in detail, the preferred embodiments of the present invention. The Figures and accompanying detailed description are provided as examples of the invention and are not intended to limit the scope of the claims appended hereto.

Figure 1:
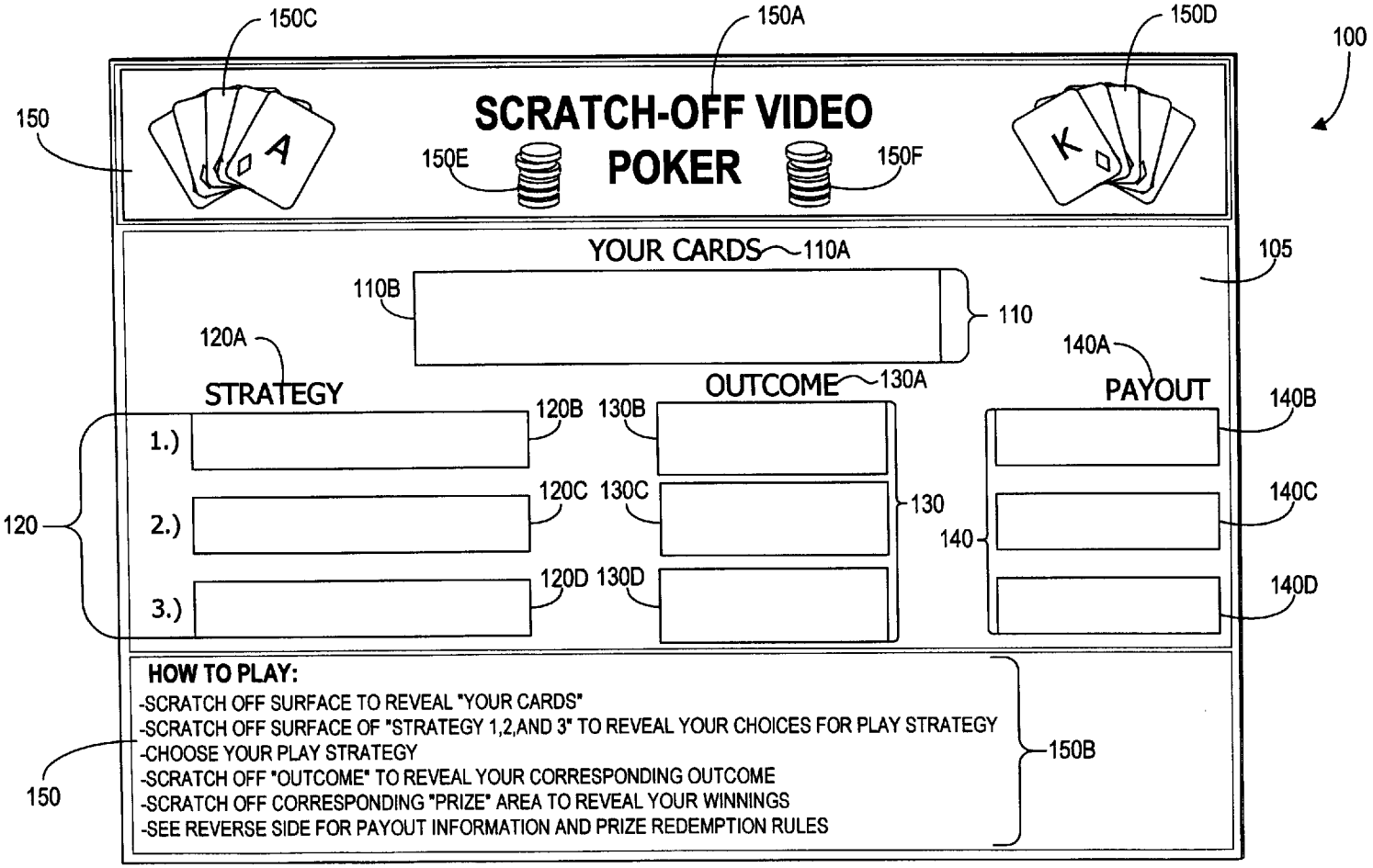
FIG. 1 depicts a ticket 100 in accordance with the present invention, as it is normally sold to a player.

Referring to FIG. 1, an inventive ticket 100 for an instant lottery game is shown. The instant lottery game is one in which a player exercises an element of skill to play the game. More particularly, the player considers game strategies and makes decisions based thereon to improve his chances of achieving a favorable outcome for the game, such as obtaining a cash payout. For example, in the present embodiment, the instant lottery game simulates a computerized video poker game. In this case, as will be described in more detail below, the player is dealt an initial hand of cards and decides which cards to hold from the initial hand. In this way, he exercises the same type of skill as he would in the computerized video poker game.

While the following description is set forth for an instant lottery game that simulates computerized video poker, it is contemplated that the game may be configured to simulate or implement any other game involving an element of skill. The invention thus may be used to play other games such as blackjack, craps, baccarat, roulette, Pai Gow, trivia, bridge, gin rummy, and games with sporting themes.

Still referring to FIG. 1, ticket 100 is depicted as it is normally sold to a player—that is, before the game has been played. Ticket 100 includes a play section 105 and a background section 150. Play section 105 includes an initial configuration section 110, a strategy section 120, and an outcome section 130. Play section 105 may also include a payout section 140.

Initial configuration section 110 is used to indicate an initial configuration (or starting point) for the game. A heading 110A, such as "YOUR CARDS," may be imprinted on ticket 100 to indicate initial configuration section 110. An alterable covering surface 110B hides initial configuration 110C (FIG. 2), which comprises indicia imprinted on ticket 100, as will be explained in more detail below. In order to hide initial configuration 110C, alterable covering surface 110B may be opaque or translucent. Further, alterable covering surface 110B is such that, when altered, it cannot easily be returned to its unaltered state.

In the exemplary embodiment in which the game simulates computerized video poker, initial configuration 110C is an initial set (or hand) of cards that is dealt to a player. In this embodiment, alterable covering surface 110B is made from a well-known scratch-off material, such as aluminum permeated latex, as is typically used on scratch-off lottery tickets. Alternatively, alterable covering surface 110B may be made of a wash-off material, such as those which are made from photosensitive, ink, thermal, or watermarked materials. In yet another embodiment, alterable covering surface 110B may be made from a peel-off material, such as a sticker, perforated paper, or the like.

Figure 2:
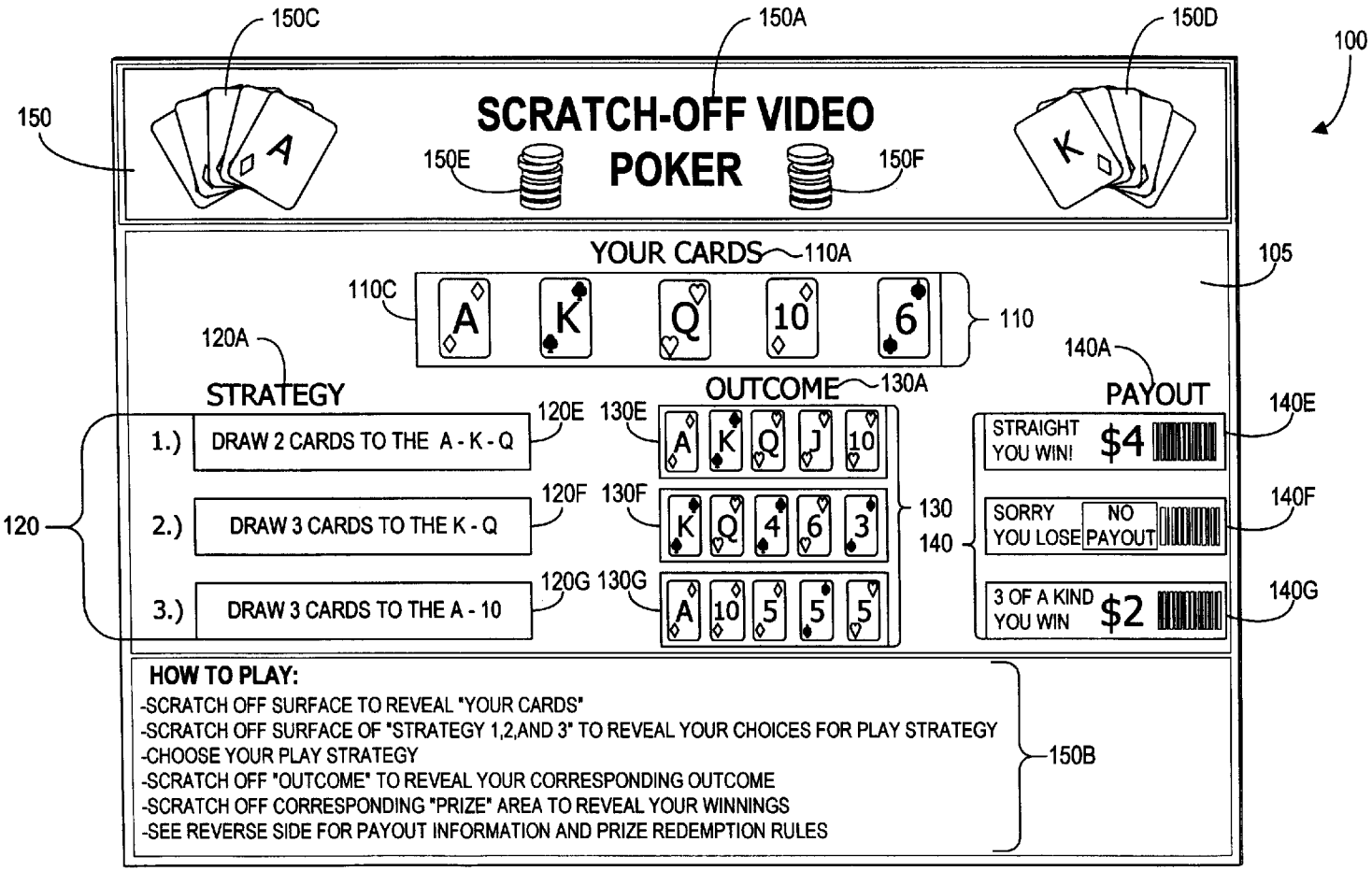
FIG. 2 depicts ticket 100 after all of the alterable covering surfaces have been altered.

Strategy section 120 is used to indicate a plurality of strategies for the game, wherein each strategy is related to initial configuration 110C (FIG. 2). A heading 120A, such as "STRATEGY," may be imprinted on ticket 100 to indicate strategy section 120. Alterable covering surfaces 120B–120D hide each of the plurality of strategies 120E–120G (FIG. 2), which comprise indicia imprinted on ticket 100, as will be explained in more detail below. Alterable covering surfaces 120B–120D may be of the type described above for alterable covering surface 110B.

In the embodiment of FIG. 1, three strategies 120E–120G (FIG. 2) will be available to the player to use during the game. The strategies relate to initial configuration 110C in that they indicate particular cards that a player may decide to hold and/or those he may decide to discard. The player will be able to exercise an element of skill by considering the strategies and deciding which strategy to use to maximize his expected value.

In an alternate embodiment of ticket 100, alterable covering surfaces 110B and 120B–120D are not used. In this case, it is apparent that initial configuration 110C and strategies 120E–120G (FIG. 2) would be viewable by a player and a vendor selling ticket 100. Therefore, to prevent the player and the vendor from ascertaining tickets for which a high payout is possible, ticket 100 is provided to the vendor and is sold to the player in a package that obscures initial configuration 110C and strategies 120E–120G from their view. Such a package may be made from an opaque or translucent foil material.

Outcome section 130 is used to indicate one of a plurality of outcomes for the game. Each outcome is associated with a corresponding one of the strategies contained in strategy section 120. A heading 130A, such as "OUTCOME," may be imprinted on ticket 100 to indicate outcome section 130. Alterable covering surfaces 130B–130D hide each of the plurality of outcomes 130E–130G (FIG. 2), which comprise indicia imprinted on ticket 100, as will be explained in more detail below. Alterable covering surfaces 130B–130D may be of the type described above for alterable covering surface 110B.

In the present embodiment, there are three possible outcomes for the game, each of which corresponds to one of the three strategies. The outcomes indicate three final hands of cards, each of which result from a decision to use the corresponding strategy. The outcome for the game is determined by the player selecting the outcome that corresponds to the strategy he decides to use.

Payout section 140 may be used to indicate one of a plurality of payouts that the player may obtain for the game. Each payout is associated with a corresponding one of the outcomes contained in outcome section 130. A heading 140A, such as "PAYOUT," may be imprinted on ticket 100 to indicate payout section 140. Alterable covering surfaces 140B–140D hide each of the plurality of payouts 140E–140G (FIG. 2), which comprise indicia imprinted on ticket 100, as will be explained in more detail below. Alterable covering surfaces 140B–140D may be of the type described above for the alterable covering surface 110B.

In the present embodiment, there are three payouts that a player may receive, each of which corresponds to one of the outcomes of the game. The payout for the game is determined by the player selecting the payout that corresponds to the selected outcome for the game, which corresponds to the strategy he decides to use.

In the exemplary embodiment depicted in FIG. 1, background section 150 of ticket 100 includes the name of the game 150A, such as "SCRATCH-OFF VIDEO POKER" and instructions 150B for playing the game. Fanciful indicia 150C–150F may be used to improve the appearance of ticket 100 in accordance with the theme of the game, here video poker. On the reverse side of ticket 100, as shown in FIG. 3C, background section 150 may also include payout information 150G, instructions 150H to claim any payout, and machine readable indicia 150I, such as a bar code, that uniquely identifies ticket 100.

FIG. 2 depicts ticket 100 after all of the alterable covering surfaces 110B, 120B–120D, 130B–130D, and 140B–140D have been altered. As is seen there, when alterable covering surface 110B is altered, initial configuration 110C is revealed. In this exemplary embodiment, initial configuration 110C comprises an initial set (or hand) of five cards that is dealt to a player e.g., Ace of diamonds (Ad), King of clubs (Kc), Queen of hearts (Qh), Ten of diamonds (10d), and Six of spades (6s). Of course, initial configuration 110C may include indicia other than cards depending on the type of game being played. Further, the number of such cards and other indicia may be made vary in accordance with the type of game that is being played.

Initial configuration 110C may be chosen to increase a player's interest in the game. Thus, in the case in which initial configuration 110C comprises the initial hand of cards, the hand may be chosen so as to leave open the possibility that the player's final hand may be a flush or a straight. Typically, these hands are more exciting to players than a pair of cards, given the potential for a higher payout. Of course, the content of initial configuration 110C may be randomly determined or otherwise made to vary as desired.

When alterable covering surfaces 120B–120D of strategy section 120 are altered, corresponding strategies 120E–120G are revealed. Strategies 120E–120G each are related to initial configuration 110C. As stated above, strategies 120E–120G allow the player to exercise an element of skill during game play. That is, the player may consider the strategies and decide which strategy to use to improve his chances of achieving a payout.

Thus, in this embodiment in which initial configuration 110C comprises the initial hand of cards Ad-Kc-Qh-10d-6s, three strategies are available to the player which relate thereto. Strategy 120E indicates that the player may decide to attempt to obtain a straight and thus draw two cards to the Ad-Kc-Qh—i.e., discard 10d-6s. Strategy 120F indicates that the player may decide to attempt to obtain a straight and thus draw three cards to the Kc-Qh -i.e., discard Ad-10d-6s. Strategy 120G indicates that the player may decide to attempt to obtain a Flush or Straight Flush and thus draw three cards to the Ad-10d—i.e., discard Kc-Qh-6s. Such a strategy provides the player with the opportunity to achieve a royal flush, the highest payout in the game.

When alterable covering surfaces 130B–130D of outcome section 130 are altered, corresponding outcomes 130E–130G for the game are revealed. As described above, each of the outcomes 130E–130G is associated with a corresponding one of strategies 120E–120G. More specifically, outcome 130E is associated with strategy 120E. Thus, if the player decides to use strategy 120E, then outcome 130E will be the outcome for the game. Here, outcome 130E indicates that the player has drawn a Jack of hearts (Jh) and a Ten of hearts (10h) so that the outcome of the game is a straight—i.e., Ad-Kc-Qh-Jh-10h.

Outcome 130F is associated with strategy 120F such that if the player decides to use strategy 120F, then outcome 130F will be the outcome for the game. Here, outcome 130F indicates that the player has drawn a Four of clubs (4c), Six of hearts (6h), and Three of spades (3s) so that the outcome of the game is a king high—i.e., Kc-Qh-4c-6h-3s. Outcome 130G is associated with the strategy 120G. Thus, if the player decides to use strategy 120G, then outcome 130G will be the outcome for the game. Here, outcome 130G indicates that the player has drawn a Five of diamonds (5d), Five of spades (5s), and Five of hearts (5h) so that the outcome of the game is Three of a Kind —i.e., Ad-10d-5d-5s-5h.

When payout section 140 is used, and alterable covering surfaces 140B–140D are altered, corresponding payouts 140E–140G are revealed. In one embodiment, each payout 140E–140G indicates a dollar amount, a bar code indicative of the dollar amount, and the name of the final hand and whether the player has won or lost. Of course, any of these or other indicia, alone or in combination, may be used as desired.

As described above, each payout 140E–140G is associated with a corresponding one of outcomes 130E–130G. More specifically, payout 140E is associated with outcome 130E. Thus, if the outcome of the game is outcome 130E, then the player will receive the dollar amount indicated by payout 140E. Here, payout 140E indicates that the outcome of the game is a straight and that the player has won four dollars.

Payout 140F is associated with outcome 130F such that if outcome 130F is the outcome for the game, then the player will receive the dollar amount indicated by payout 140F. Here, payout 140F indicates that the player loses and there is no dollar amount to be paid. Payout 140G is associated with outcome 130G. Thus, if outcome 130G is the outcome for the game, then the player will receive the dollar amount indicated by payout 140G, here "$2."

The use of machine readable indicia, such as the bar code, assists vendors in ascertaining the appropriate payout for ticket 100. For example, in the embodiment of FIG. 2, the vendor may scan the bar code for the outcome of the game so that the appropriate dollar amount is displayed to him on a computer screen. Alternatively, the bar code 150I (FIG. 3C), which uniquely identifies ticket 100, may be used to access a database so that all three of the dollar amounts of payouts 140E–140G may be displayed to the vendor. Thus, when displayed, the vendor may be assured that the dollar amount of the payout is valid.

In yet another embodiment, ticket 100 may be provided with an electrical circuit therein, in accordance with the teaching of U.S. Pat. No. 5,475,205, issued to Behm et al. and incorporated herein by reference. In this case, a payout can be determined using an electronic verification device to determine which alterable covering surfaces have been altered on ticket 100 and to calculate an appropriate dollar amount payout therefrom.

In the present embodiment in which the game simulates video poker, the payouts and the expected values are made to differ from those described above with reference to payout table 1100 (FIG. 11) for computerized video poker. More specifically, FIG. 3A depicts a payout table 300 that may be used to calculate payouts for the game of the present invention. As is seen there, cells 305A–305J each indicate a final hand that is possible for a player to receive, given an initial hand. The final hands of cells 305A–305J are the same as those in cells 1105A–1105J (FIG. 11). Cells 310A–310J each indicate a payout that the associated final hand will pay if it is achieved. Cells 320A–320J each depict an expected value of the associated final hand, given the associated payout, indicating the house advantage of the game associated with these payout levels.

A comparison of cells 305A–305J and cells 1105A–1105J indicate that the payouts for Three Of A Kind and Two Pair have been made to differ. That is, the payouts have been changed from $4 to $2 for Three Of A Kind, and from $2 to $1 for Two Pair. As a result of this change, the expected values of cells 320G–320H are calculated as $0.1490 and $0.1294, which is less than the expected values $0.2235 and $0.2588 for computerized video poker, respectively, shown in cells 1120G–1120H. Thus, the total expected value shown in cell 320K for the inventive instant lottery game is $0.7910. This means that tickets will return (assuming best player strategy) an average of 79 cents over an extended period of time. The total expected value shown in cell 320K for the instant lottery video poker game has thus been made lower than that of the computerized video poker game. This serves to increase the lottery's advantage so that it more closely resembles the typical 60 cent payout for instant lottery tickets. The higher payouts of video poker are not desirable for ticket based games because of the higher cost associated with printing and distributing tickets.

The universe of strategies that theoretically may be available for a player to use for a given initial configuration 110C may be such that it would be impractical, if not impossible, to present them to the player within the confines of ticket 100. Moreover, even if possible, the number of such strategies would be make the ticket cluttered, confusing, and visually unappealing, as in the case of the prior art Gumina patent.

Thus, in this embodiment, a subset of this universe that includes the strategies that are most likely to result in a player achieving a favorable outcome for the game are presented to the player. Here, those strategies are the three with the highest expected values, rather than all of the thirty-two possible strategies.

More specifically, given initial configuration 110C which comprises an initial hand of five cards, there are thirty-two possible draw combinations. If the expected value of each of the thirty-two possible draw combinations is calculated as described below in FIG. 3B and ranked in descending order, then the three strategies that are included on ticket 100 for the player to play are those with the highest expected values.

Figure 3B:
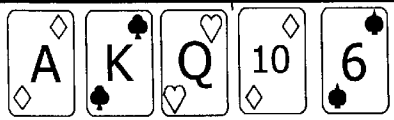
FIG. 3B depicts a table showing how expected values of final hands may be determined.

FIG. 3B shows the calculation for these expected values in more detail. As is seen there, initial configuration 110C, and strategies 120E–120G are shown for reference as 325 and 330A–330C, respectively. Cells 335A–335J each indicate a final hand that is possible for a player to receive, given the initial hand indicated by reference number 325. Cells 340A–340J each indicate a payout that the associated final hand will pay if it is received. Cells 350A–350J, 360A–370J, and 370A–370J each indicate a number of different draws that can result in a final hand, if the strategies noted by reference numbers 330A, 330B, and 330C are followed, respectively. Cells 355A–355J, 365A-365-365J, and 375A–375J each indicate the total payout associated with each possible outcome and are calculated by multiplying a payout from column 340 by an associated draw from column 350, 360, or 370, respectively.

The totals 350K, 355K, 360K, 365K, 370K, and 375K are calculated by adding cells 350A–350J, 355A–355J, 360A–360J, 365A-365-J, 370A–370J, and 375A–375J, respectively. The expected value 355L is calculated by dividing the total payout 355K by the total draws 350K. The expected value 365L is calculated by dividing the total payout 365K by the total draws 360K. The expected value 375L is calculated by dividing the total payout 375K by the total draws 370K. As is readily apparent, if the player is given these three strategies, the one which would most increase his chances of achieving a favorable outcome for the game is the strategy shown in 330B since it results in the highest expected value.

Figure 4:
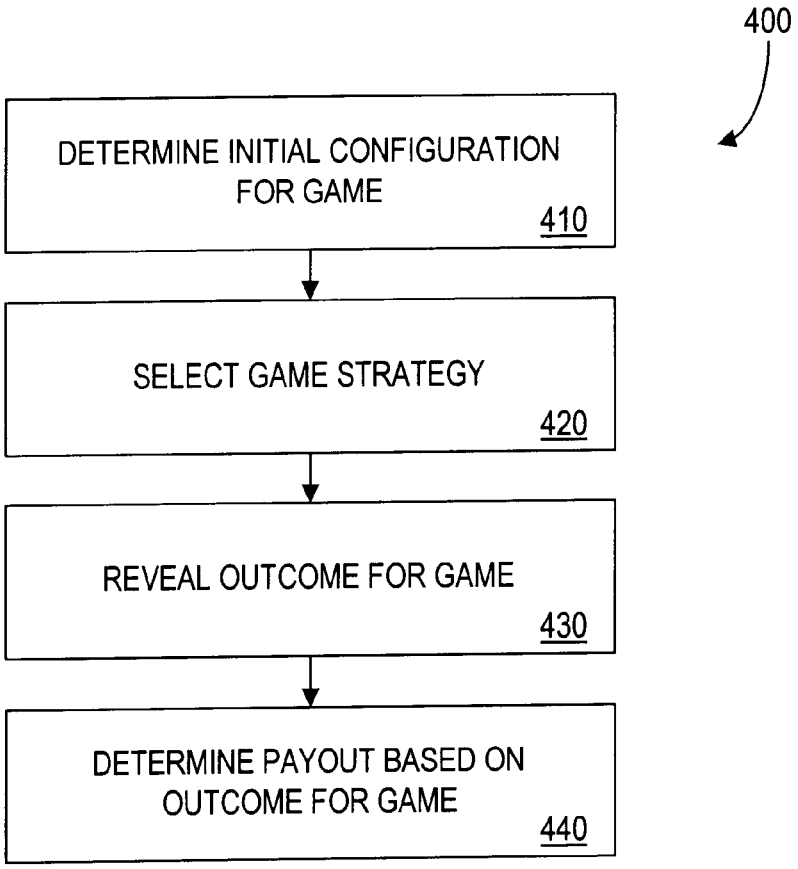
FIG. 4 is a flow chart for a process 400 by which a player plays the instant lottery game using ticket 100.
Figure 5A:
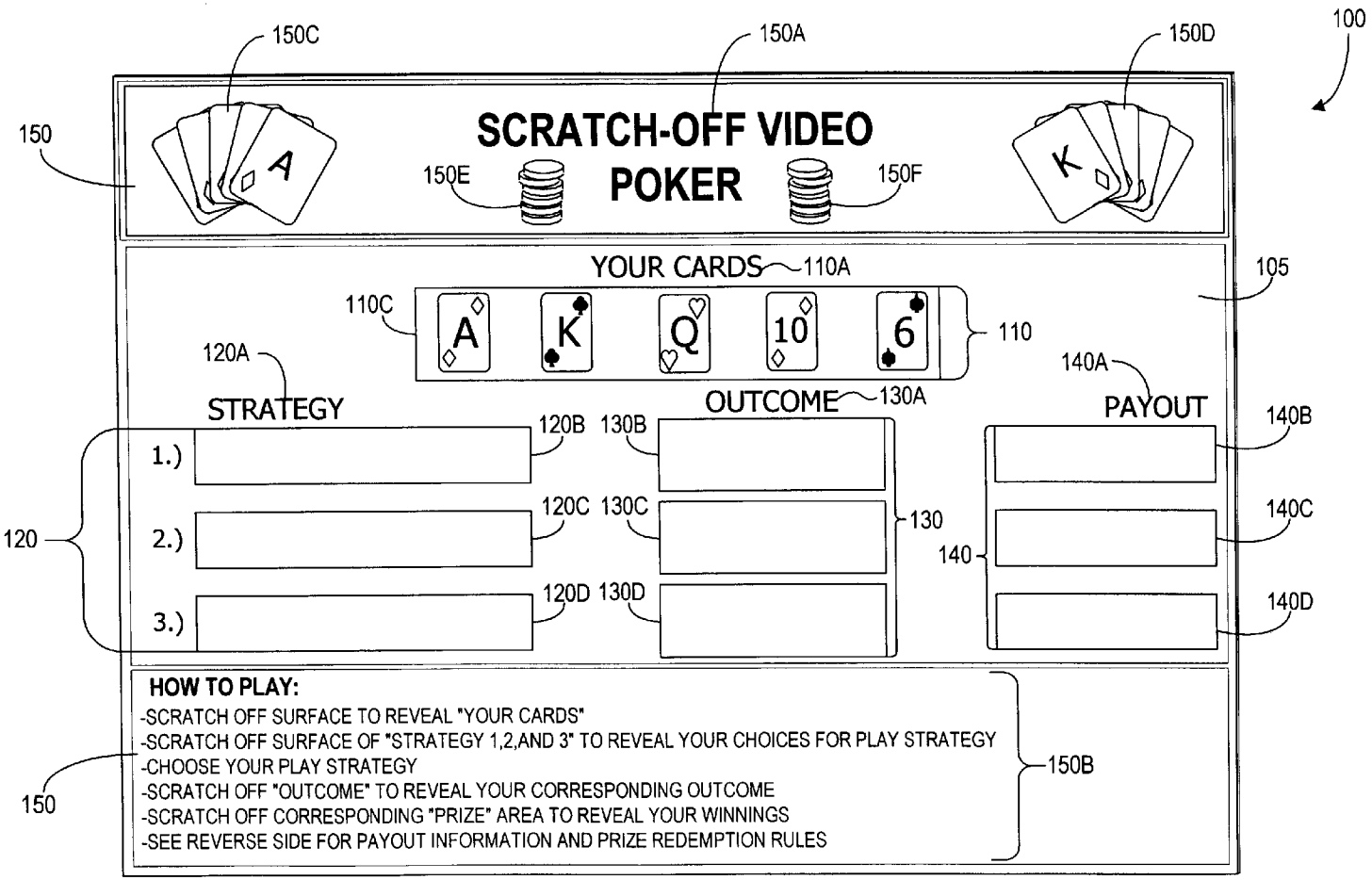
FIG. 5A depicts ticket 100 after the initial configuration has been revealed.

FIG. 4 illustrates a process 400 by which a player plays the instant lottery game using ticket 100. At step 410, the player determines an initial configuration for the game. In this embodiment, the player thus alters the alterable covering surface 110B (FIG. 1) to reveal initial configuration 110C (FIG. 2). In this way, initial configuration 110C is revealed in the form of the player's initial hand of cards—Ad-Kc-Qh-10d-6s. FIG. 5*a* depicts the state of ticket 100 after step 410 is performed.

Figure 5B:
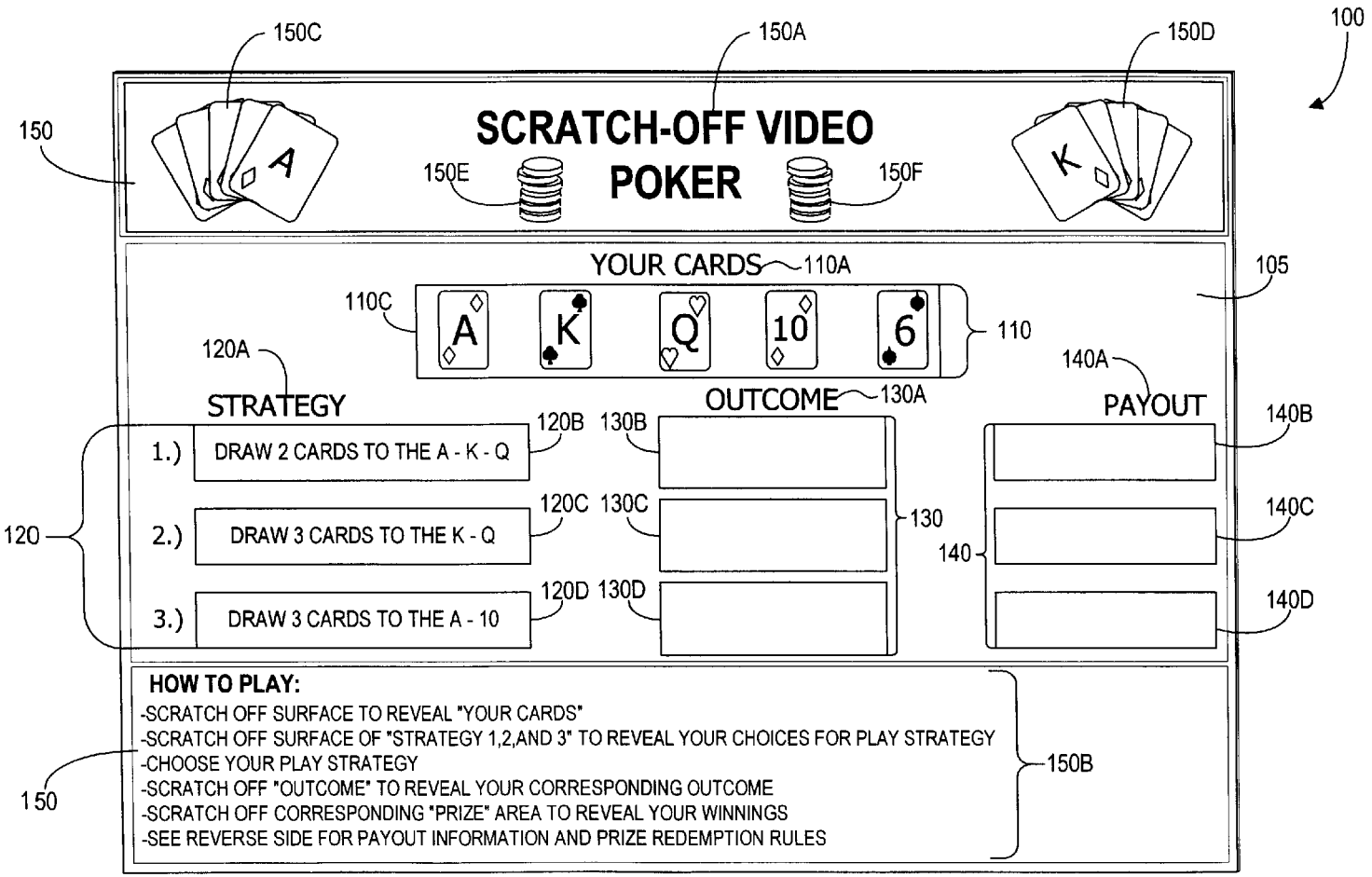
FIG. 5B depicts ticket 100 after the initial configuration and the strategies have been revealed.

At step 420, the player selects a game strategy from game strategies 120E–120G. To do this, the player alters alterable covering surfaces 120B–120D (FIG. 1) to reveal each of the game strategies 120E–120G (FIG. 2). Then, the player exercises an element of skill. That is, the player considers revealed game strategies 120E–120G and makes a decision as to which strategy to use. FIG. 5*b* depicts the state of ticket 100 after step 420 is performed.

Figure 5C:
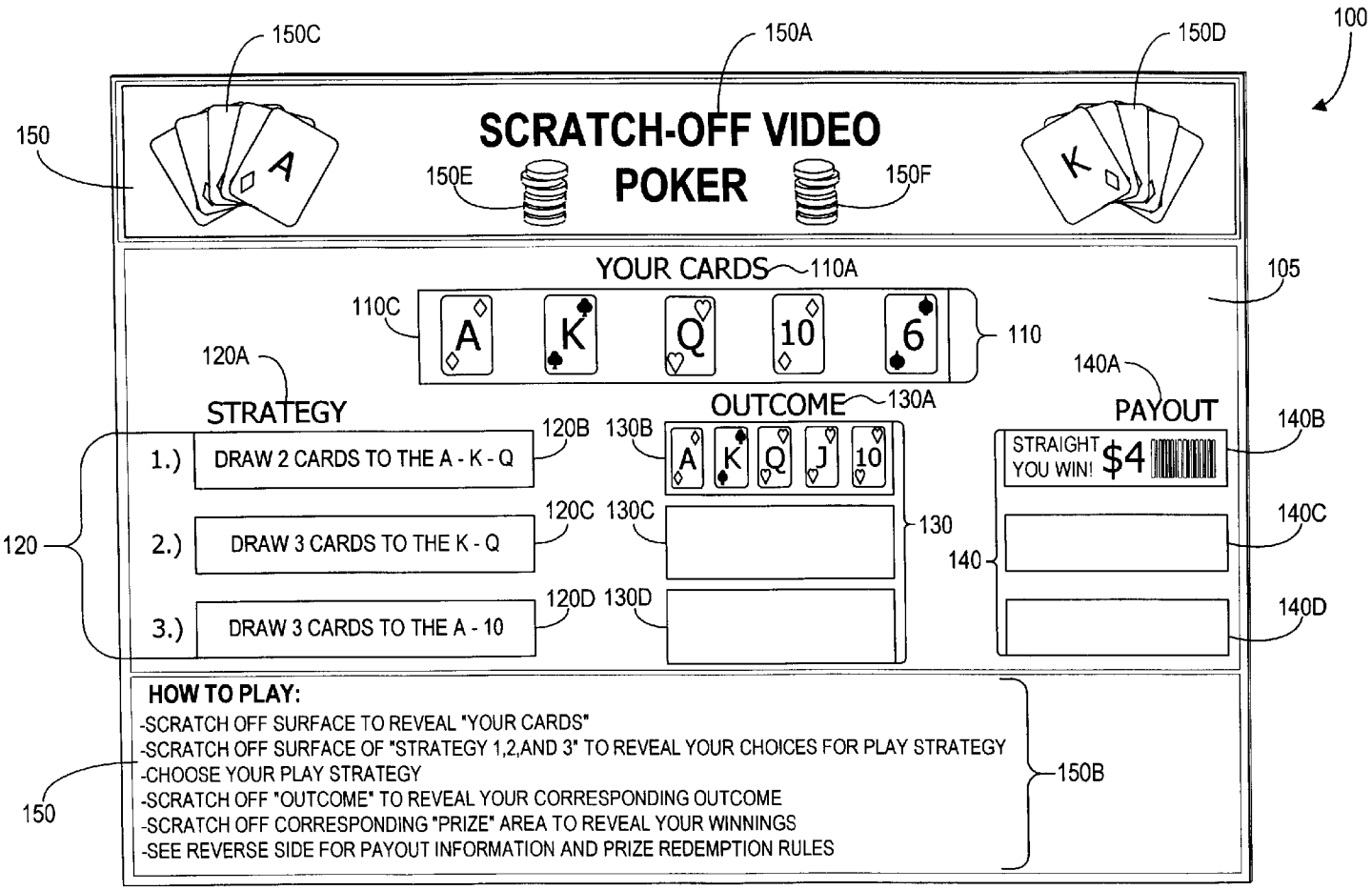
FIG. 5C depicts ticket 100 after the game has been completed.

At step 430, the player reveals the outcome for the game. To do this, the player alters alterable covering surface 130B–130D that is associated with the game strategy that he has decided to use. For example, if the player chooses strategy 120B, then the alterable covering surface 130B would also be altered. In this case, the outcome of the game would be a straight (Ad-Kc-Qh-Jh-10h), as depicted in FIG. 5c. If the player alters more than one of alterable areas 130B–130D, then ticket 100 becomes void.

If ticket 100 is configured to include payout section 140, then, at step 440, the player may determine the payout he has won based on the outcome revealed at step 430. Thus, the player may alter one of alterable covering surfaces 140B–140D that is associated with the selected outcome of the game. In this example, the player would remove alterable covering surface 140B, which is associated with outcome 130E. As shown n FIG. 5c, payout 140E indicates that the outcome of the game is a "straight" and that the player has won four dollars. At this point, process 400 is complete.

Figure 6:
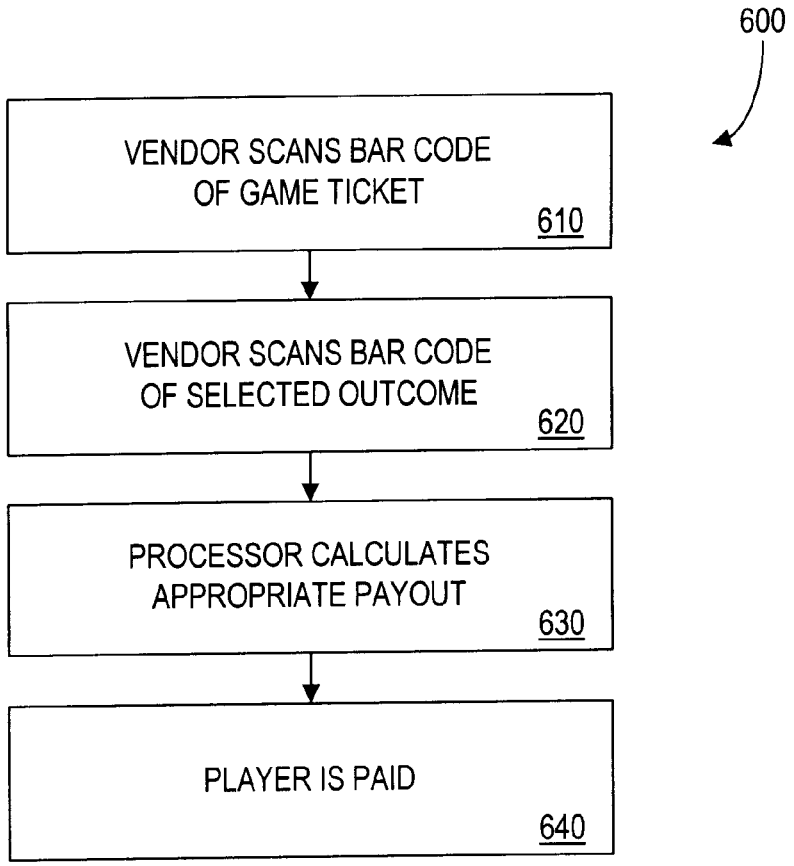
FIG. 6 is a flow chart for a process 600 by which a player may claim a payout.

FIG. 6 is a flow chart for a process 600 by which a player may claim his payout. At step 610, the vendor identifies ticket 100 that is being redeemed. To do this, the vendor uses a scanning device to scan the bar code 1501 (FIG. 3C), which uniquely identifies ticket 100. At step 620, the vendor determines the payout for ticket 100. Thus, the vendor uses the scanning device to scan the bar code that is included as part of payout 140B. At step 630, a processor in communication with the scanning device receives the bar code data and calculates the payout, which is displayed to the vendor on a computer screen. The vendor then pays the player the appropriate dollar amount payout at step 640 where process 600 is complete. Of course, process 600 may be modified accordingly to accommodate alternate embodiments of ticket 100, such as the one in which ticket 100 is provided with an electrical circuit to determine the appropriate payout for ticket 100.

Figure 7A:
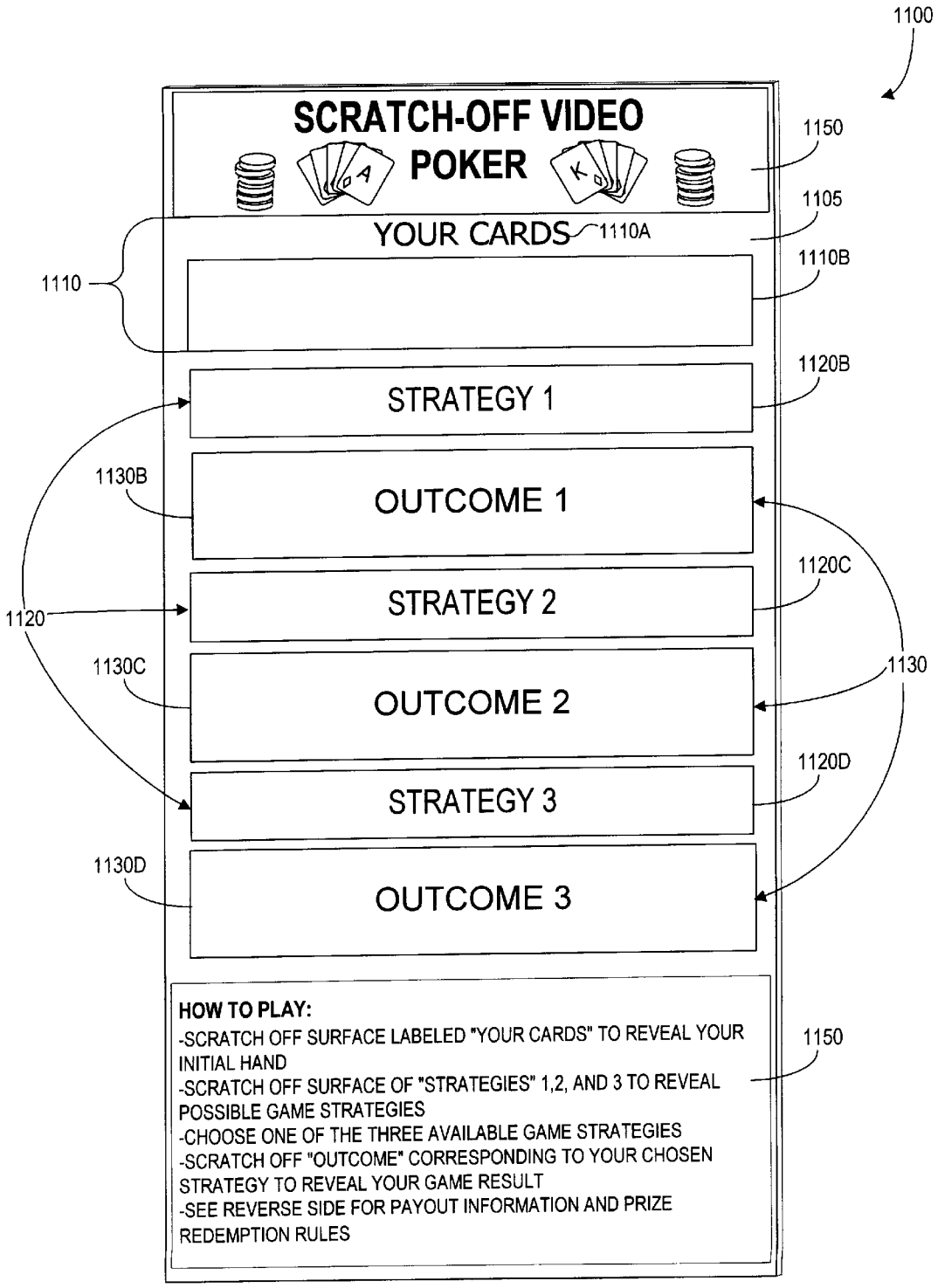
FIG. 7A depicts an alternative embodiment of a ticket 1100 in accordance with the present invention, as it is normally sold to a player.

Referring next to FIGS. 7A and 71B, an alternate embodiment of an inventive ticket 1100 for an instant lottery game is described. In FIG. 7A, ticket 1100 is depicted as it is normally sold to a player—that is, before the game has been played. Ticket 1100 includes a play section 1105 and a background section 1150. The play section 1105 includes an initial configuration section 1110, a strategy section 1120, and an outcome section 1130.

Initial configuration section 1110 is used to indicate an initial configuration (or starting point) for the game. A heading 1110A, such as "YOUR CARDS," may be imprinted on ticket 1100 to indicate initial configuration section 1110. An alterable covering surface 11103B hides initial configuration 1110C (FIG. 7B), which comprises indicia imprinted on the ticket 1100, as will be explained in more detail below. Alterable covering surface 1110B may be of the type described above for the alterable covering surface 110B (FIG. 1). In the exemplary embodiment in which the game simulates video poker, initial configuration 1110C is an initial set (or hand) of five cards that is provided to a player.

Figure 7B:
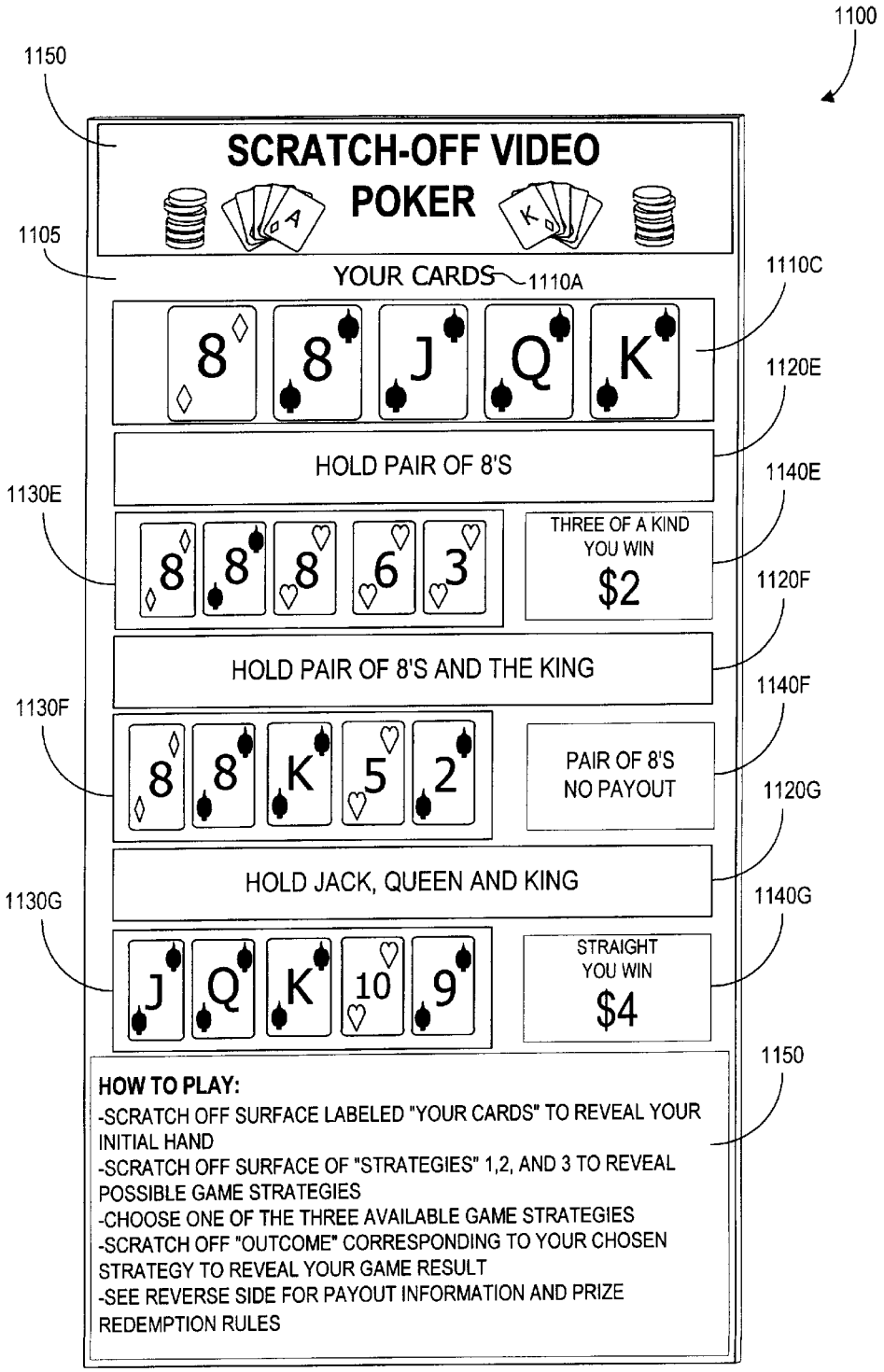
FIG. 7B depicts ticket 1100 after all of the alterable covering surfaces have been altered.

Strategy section 1120 is used to indicate a plurality of strategies for the game, wherein each strategy is related to initial configuration 1110C (FIG. 7B). Alterable covering surfaces 1120B–1120D hide each of the plurality of strategies 1120E–1120G (FIG. 7B), which comprise indicia imprinted on the ticket 1100, as will be explained in more detail below. Alterable covering surfaces 1120B–1120D may be of the type described above for alterable covering surface 110B (FIG. 1). Headings, such as "STRATEGY 1," "STRATEGY 2," and "STRATEGY 3" may be imprinted on the alterable covering surfaces 1120B–1120D, respectively, to indicate the strategies of section 1120.

In the embodiment of FIG. 7A, three strategies 1120E–1120G (FIG. 7B) will be available to the player to use during the game. The strategies relate to initial configuration 1110C (FIG. 7B) in that they indicate particular cards that a player may decide to hold and/or those he may decide to discard. The player then will be able to exercise an element of skill by considering the strategies and deciding which strategy to use to improve his chances of obtaining a payout. Similar to alterable covering surfaces 110B and 120B–120D of ticket 100, alterable covering 1110B and 1120B–1120D need not be used if ticket 1100 is sold in a package that obscures such alterable covering surfaces from the view of players and vendors.

Outcome section 1130 is used to indicate one of a plurality of outcomes 1130E–1130G (FIG. 7B) for the game. Each outcome is associated with a corresponding one of the strategies contained in strategy section 1120. Alterable covering surfaces 1130B–1130D hide each of the plurality of outcomes 1130E–1130G (FIG. 7B), which comprise indicia imprinted on ticket 1100, as will be explained in more detail below. Alterable covering surfaces 1130B–1130D may be of the type described above for the alterable covering surface 110B (FIG. 1). Headings, such as "OUTCOME 1," "OUTCOME 2," and "OUTCOME 3" may be imprinted on alterable covering surfaces 1130B–1130D, respectively, to indicate the outcomes of section 1130.

In the present embodiment, there are three possible outcomes for the game, each of which corresponds to one of the three strategies. The outcomes indicate three final hands of cards, each of which result from a decision to use the corresponding strategy. The outcome for the game is determined by the player selecting the one outcome that corresponds to the strategy he decides to use.

In this embodiment of the inventive ticket 1100, payouts that the player may win for the game, if any, are hidden under alterable covering surfaces 1130B–1130D. Thus, each payout is associated with a corresponding one of the outcomes contained in outcome section 1130.

In the exemplary embodiment depicted in FIG. 7A, background section 1150 of ticket 1100 may be configured to include information similar to the type described above with reference to background section 150 (FIG. 1).

FIG. 7B depicts ticket 1100 after all of alterable covering surfaces 1110B, 1120B–1120D, and 1130B–1130D have been altered. As is seen there, when alterable covering surface 1110B is altered, initial configuration 1110C is revealed. In this exemplary embodiment, initial configuration 1110C comprises an initial set (or hand) of five cards that is dealt to a player—e.g., Eight of diamonds (8d), Eight of spades (8s), Jack of spades (Js), Queen of spades (Qs), and King of spades (Ks). Initial configuration 1110C may be chosen and configured as described above for initial configuration 110C (FIG. 2).

When alterable covering surfaces 1120B–1120D of strategy section 120 are altered, corresponding strategies 1120E–1120G are revealed. Strategies 1120E–1120G each are related to initial configuration 1110C. Similar to strategies 120E–120G of ticket 100, strategies 1120E–1120G allow the player to exercise an element of skill during game play. That is, the player may consider the strategies and decide which strategy to use to improve his chances of achieving a payout.

Thus, in this embodiment in which the initial configuration 1110C comprises the initial hand of cards 8d-8s-Js-Qs-Ks, three strategies are available to the player which relate thereto. Strategy 1120E indicates that the player may decide to attempt to obtain a hand such as Three or Four of a Kind and thus hold the pair of eights—i.e., discard Js-Qs-Ks. Strategy 1120F indicates that the player may decide to attempt to obtain a hand such as Two Pair or a Full House and thus hold the pair of eights and the king (8d-8s-Ks)—i.e., discard Js-Qs. Strategy 1120G indicates that the player may decide to attempt to obtain a Straight Flush and thus hold the jack, queen, and king (Js-Qs-Ks)—i.e., discard 8s-8d.

In an alternate embodiment of ticket 1100, each of the strategies 1120E–1120G may include indicia that indicate a maximum payout if the strategy is selected. Thus, for example, strategy 1120E may be modified such that it indicates to hold the pair of eights and that the maximum payout for the player's use of this strategy is $25.

When alterable covering surfaces 1130B–1130D of outcome section 1130 are altered, corresponding outcomes 1130E–1130G for the game are revealed. As described above, each outcome 1130E–1130G is associated with a corresponding one of strategies 1120E–1120G. More specifically, outcome 1130E is associated with strategy 1120E. Thus, if the player decides to use strategy 1120E, then outcome 1130E will be the outcome for the game. Here, outcome 1130E indicates that the player has drawn an Eight of hearts (8h), Six of hearts (6h), and Three of hearts (3h) so that the outcome of the game is a three of a kind (8's)—i.e., 8d-8s-8h-6h-3h, and that the payout for this final hand is "$2."

Outcome 1130F is associated with the strategy 1120F such that if the player decides to use strategy 1120F, then outcome 1130F will be the outcome for the game. Here, outcome 1130F indicates that the player has drawn a Five of hearts (5h) and Two of spades (2s) so that the outcome of the game is a pair of eights—i.e., 8d-8s-Ks-5h-2s, and that there is no payout for this final hand. Outcome 1130G is associated with strategy 1120G. Thus, if the player decides to use strategy 1120G, then outcome 1130G will be the outcome for the game. Here, outcome 1130G indicates that the player has drawn a Ten of hearts (10h) and Nine of spades (9s) so that the outcome of the game is a straight—i.e., Js-Qs-Ks-10h-9s, and that the payout for this final hand is "$4."

The instant lottery game using ticket 1100 is played in the same manner as the game described above for ticket 100—i.e., according to process 400 (FIG. 4). Additionally, ticket 1100 may be configured to include machine readable indicia, such as bar codes, that are indicative of payouts. Ticket 1100 may also include electrical circuits therein so that payouts may be determined using an electronic verification device, such as the one described above. Further, strategies 1120E–1120G may be chosen in the same manner as strategies 120E–120G. Still further, process 600 may be used by a player to claim his payout.

Figure 8A:
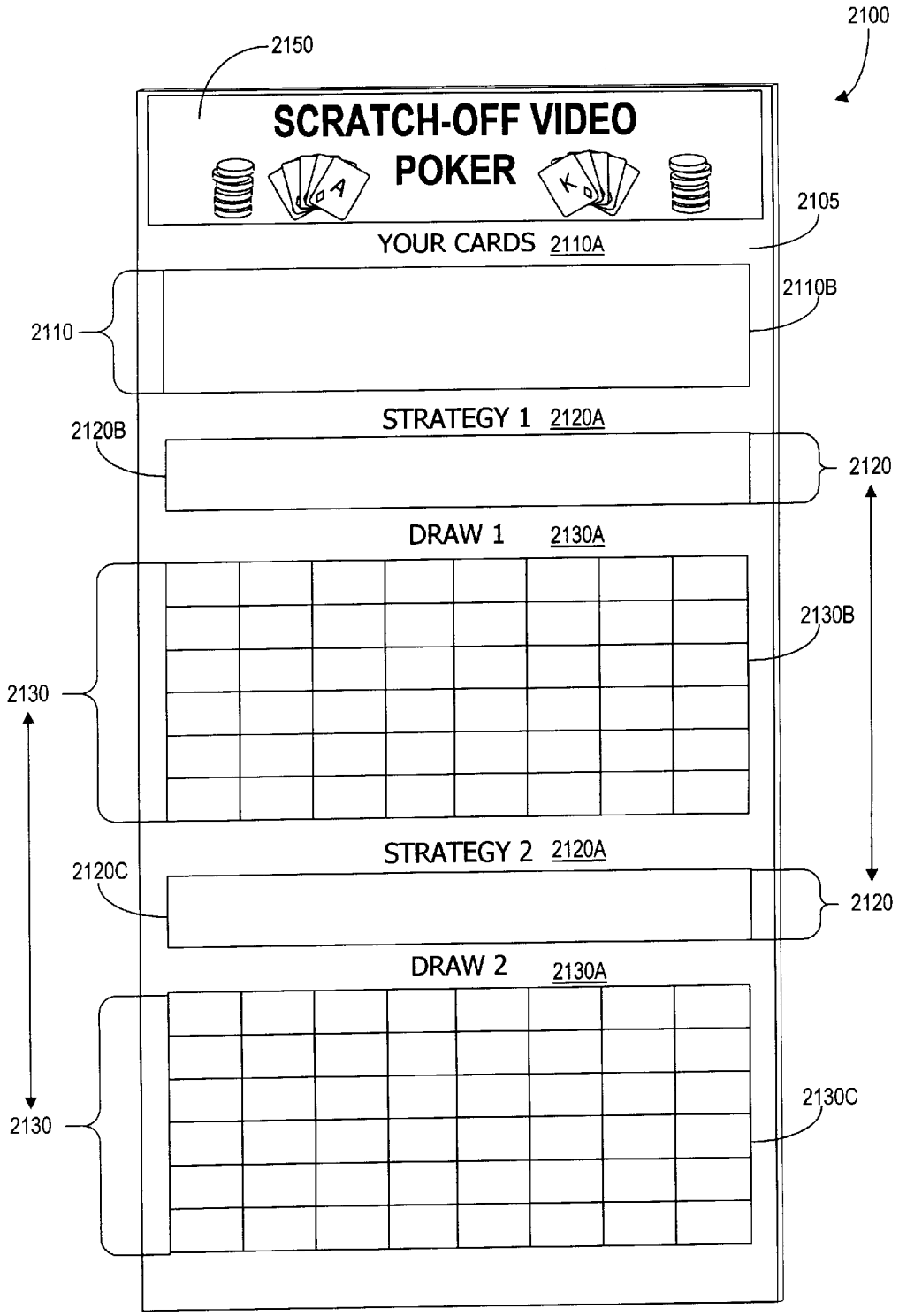
FIG. 8A depicts an alternative embodiment of a ticket 2100 in accordance with the present invention, as it is normally sold to a player.
Figure 8B:
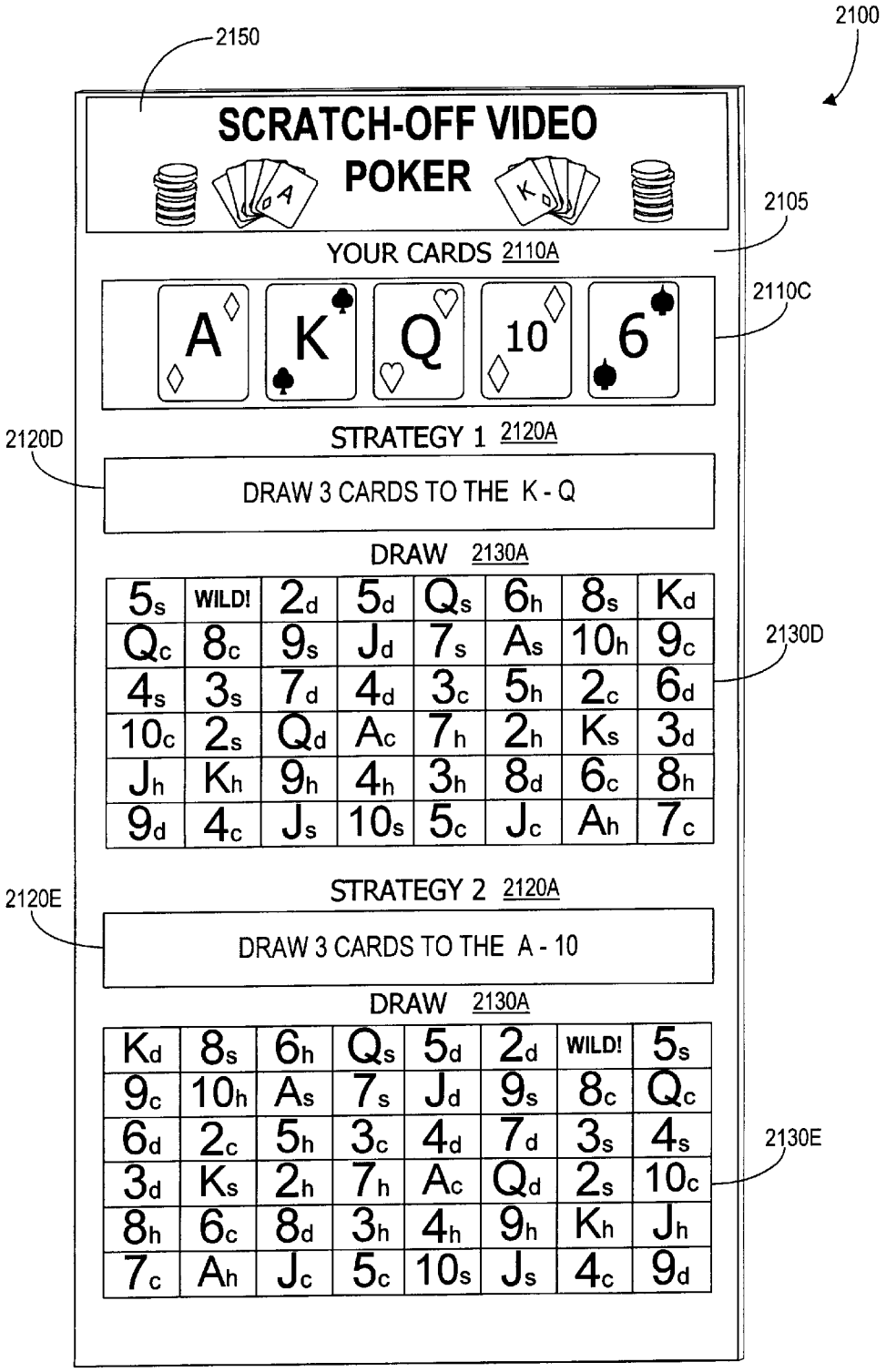
FIG. 8B depicts ticket 2100 after all of the alterable covering surfaces have been altered.

Referring next to FIGS. 8A and 8B, an alternate embodiment of an inventive ticket 2100 for an instant lottery game is described. In FIG. 8A, ticket 2100 is depicted as it is normally sold to a player—that is, before the game has been played. In this embodiment, the game has game indicia associated with it. For example, in the case in which the game simulates computerized video poker, the game indicia include the fifty-two cards that make up a standard deck of playing cards. The game indicia may also include jokers and wildcards.

Ticket 2100 includes a play section 2105 and a background section 2150. Play section 2105 includes an initial configuration section 2110, a strategy section 2120, and an outcome section 2130. Play section 2105 may also include a payout section (not shown) similar to the type described above.

Initial configuration section 2110 is used to indicate an initial configuration (or starting point) for the game. A heading 2110A, such as "YOUR CARDS," may be imprinted on ticket 2100 to indicate initial configuration section 2110. An alterable covering surface 2110B hides an initial configuration 2110C (FIG. 8B), which comprises indicia imprinted on ticket 2100, as will be explained in more detail below.

In this exemplary embodiment in which the game simulates video poker, initial configuration 2110C includes a subset of the game indicia—e.g., an initial set (or hand) of five cards that may be dealt to a player. Alterable covering surface 2110B may be of the type described above for alterable covering surface 110E (FIG. 1).

Strategy section 2120 is used to indicate a plurality of strategies for the game, wherein each strategy is related to the initial configuration. Headings 2120A, such as "STRATEGY 1," and "STRATEGY 2," may be imprinted on ticket 2100 to indicate strategies of section 2120. Alterable covering surfaces 2120B–2120C hide each of the plurality of strategies 2120D–2120E (FIG. 8B), which comprise indicia imprinted on the ticket 2100, as will be explained in more detail below. Alterable covering surfaces 2120B–2120C may be of the type described above for alterable covering surface 1103B (FIG. 1).

In this embodiment, two strategies 2120D–2120E (FIG. 8B) will be available to the player to use during the game. The strategies relate to the initial hand in that they indicate particular cards that a player may decide to hold and/or those he may decide to discard. The player then will be able to exercise an element of skill by considering the strategies and deciding which strategy to use to improve his chances of obtaining a payout.

Similar to alterable covering surfaces 110B and 120B–120D of ticket 100, alterable covering 1110B and 1120B–1120D need not be used if ticket 1100 is sold in a package that obscures such alterable covering surfaces from the view of players and vendors.

Outcome section 2130 includes a plurality of outcome areas 2130D–2130E (FIG. 8B) for the game, from which the outcome for the game will be determined. Headings 2130A, such as "DRAW 1" and "DRAW 2" may be imprinted on ticket 2100 to indicate outcome section 2130. Each outcome area 2130D–2130E is associated with a corresponding one of the strategies contained in strategy section 2120.

Alterable covering surfaces 2130B–2130C each are in the form of a grid having a plurality of cells, wherein each cell is defined by a particular row and column. Alterable covering surfaces 2130B–2130C may be of the type described above for the alterable covering surface 110B (FIG. 1).

Each alterable covering surface 2130B–2130C hides a plurality of indicia. Each of the plurality of indicia represent the complement of the subset including the initial configuration. For example, in this embodiment in which the game indicia include the fifty-two cards in a standard deck of playing cards, the plurality of indicia include forty-seven cards and may also include jokers and wild cards. The forty-seven cards represent those contained in the deck of fifty-two cards, with the exception of the cards shown in initial configuration 2110C. In the present embodiment, the player will draw a number of cards, based on a selected strategy, by altering cells of one of alterable areas 2130B–2130C to reveal a corresponding number of cards.

Thus, in view of the above, a player influences the outcome of a game by being able to select from among all possible remaining game indicia. Applicants have recognized that such an ability to select from all possible game indicia—rather than from only a few preselected by the designer or manufacturer of the ticket—significantly increases player enjoyment. This is because the player is a provided with a feeling that he can control the outcome of the game by having all remaining game indicia from which to choose.

In this embodiment, ticket 2100 may include a background section. It may be configured to include information similar to the type described above with reference to background section 150 (FIG. 1).

FIG. 8B depicts ticket 2100 in which alterable covering surfaces 2110B, 2120B–2120C, and 2130B–2130C have been altered. As is seen there, when alterable covering surface 2110B is altered, initial configuration 2110C is revealed. In this embodiment, initial configuration 2110C comprises the subset of the game indicia—e.g., an initial set (or hand) of five cards that is dealt to a player from a deck of fifty-two cards. Here, the initial configuration includes the Ace of diamonds (Ad), King of clubs (Kc), Queen of hearts (Qh), Ten of diamonds (10d), and Six of spades (6s). Initial configuration 2110C may be chosen and configured as described above for the initial configuration 110C (FIG. 2).

When alterable covering surfaces 2120B–2120C of strategy section 2120 are altered, corresponding strategies 2120D–2120E are revealed. Strategies 2120D–2120E each are related to initial configuration 2110C. Similar to the strategies described previously, strategies 2120D–2120E allow the player to exercise an element of skill during game play. That is, the player may consider the strategies and decide which strategy to use to improve his chances of achieving a payout.

Thus, in this embodiment in which initial configuration 2110C comprises the initial hand of cards Ad-Kc-Qh-10d-6s, two strategies are available to the player which relate thereto. The strategy 2120D indicates that the player may decide to attempt to obtain a hand such as a Straight and thus draw three cards to the Kc-Qh—i.e., discard Ad-10d-6s. Strategy 2120E indicates that the player may decide to attempt, to obtain a Flush or a Straight Flush and thus draw three cards to the Ad-10d—i.e., discard Kc-Qh-6s.

When alterable covering surfaces 2130B–2130C of outcome section 2130 are altered, the plurality of indicia representing the complement of the subset including the initial configuration are revealed. In this example, the plurality of indicia thus represent forty-seven cards of the deck from which the initial configuration was dealt and a wild card. An outcome for the game will be determined from this complementary set. More specifically, a predetermined number of the forty-eight cards will be revealed when the player alters cells of an alterable covering surface 2130B–2130C.

Figure 8C:
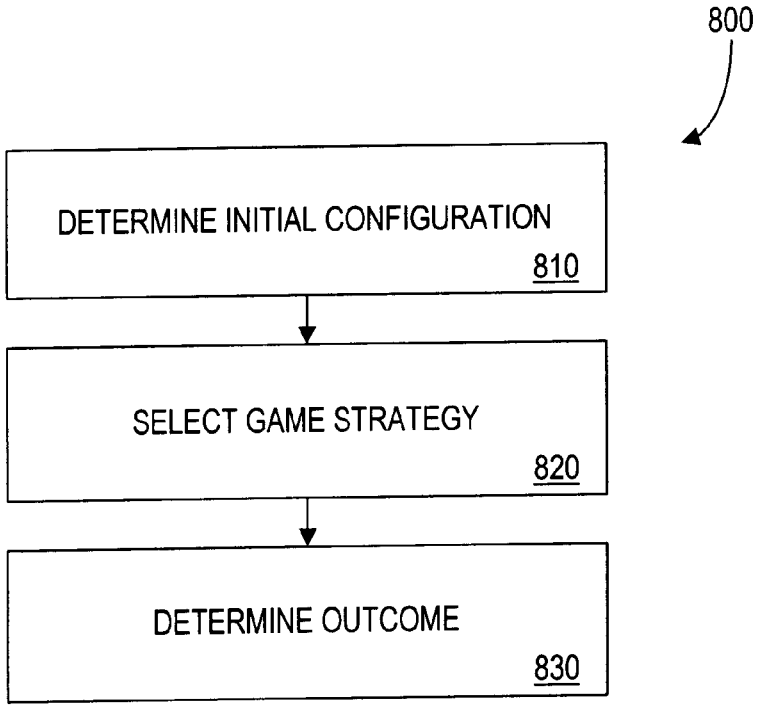
FIG. 8C is a flow chart for a process 800 by which a player plays the instant lottery game using ticket 2100.
Figure 8D:
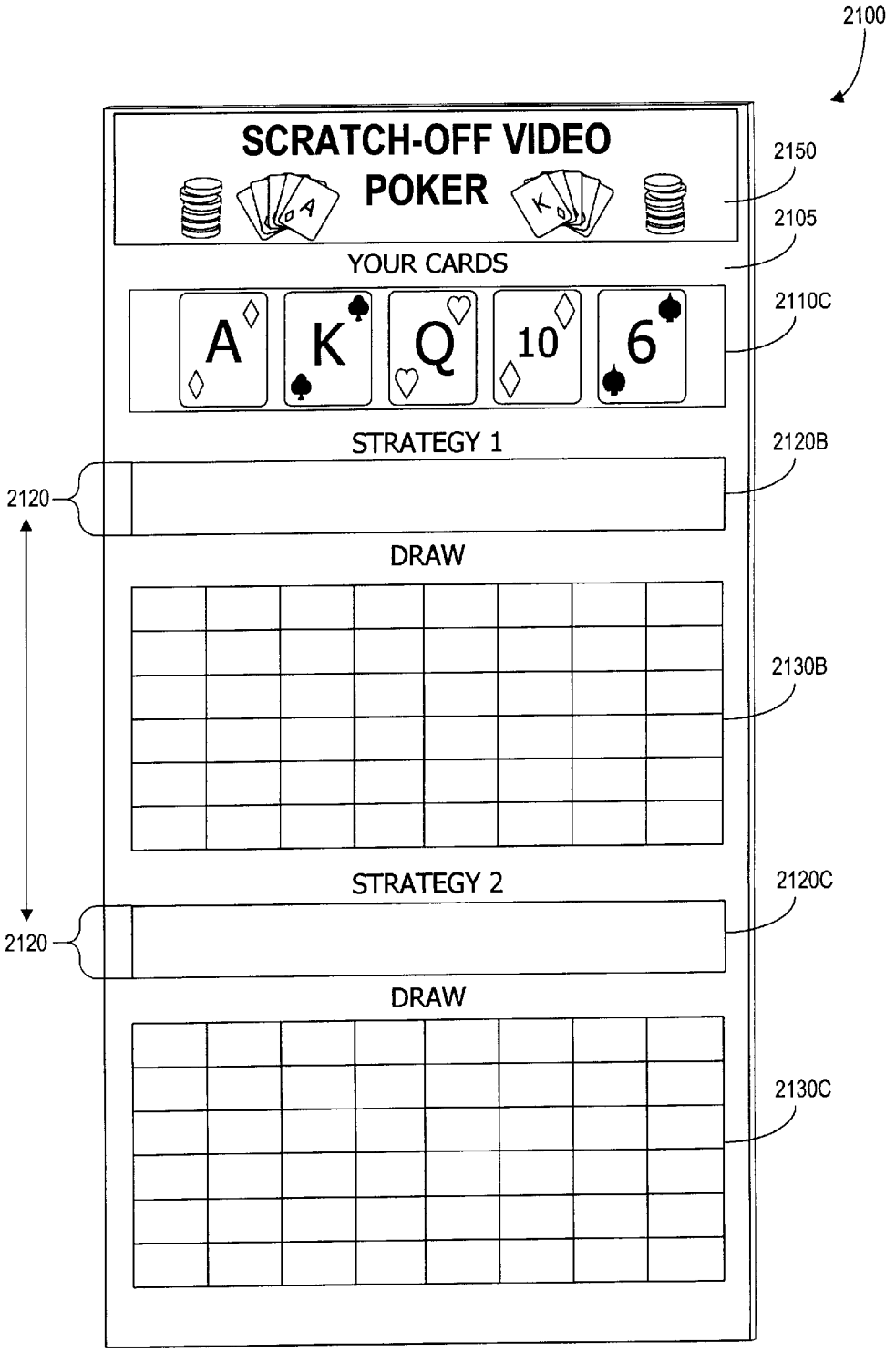
FIG. 8D depicts ticket 2100 after the initial configuration has been revealed.

FIG. 8C illustrates a process 800 by which a player plays the instant lottery game using ticket 2100. At step 810, the player determines an initial configuration for the game. In this embodiment, the player thus alters the alterable covering surface 2110B (FIG. 8A) to reveal initial configuration 2110C (FIG. 8B). In this way, initial configuration 2110C is revealed in the form of the player's initial hand of cards—Ad-Kc-Qh-10d-6s. FIG. 8D depicts the state of ticket 2100 after step 810 is performed.

Figure 8E:
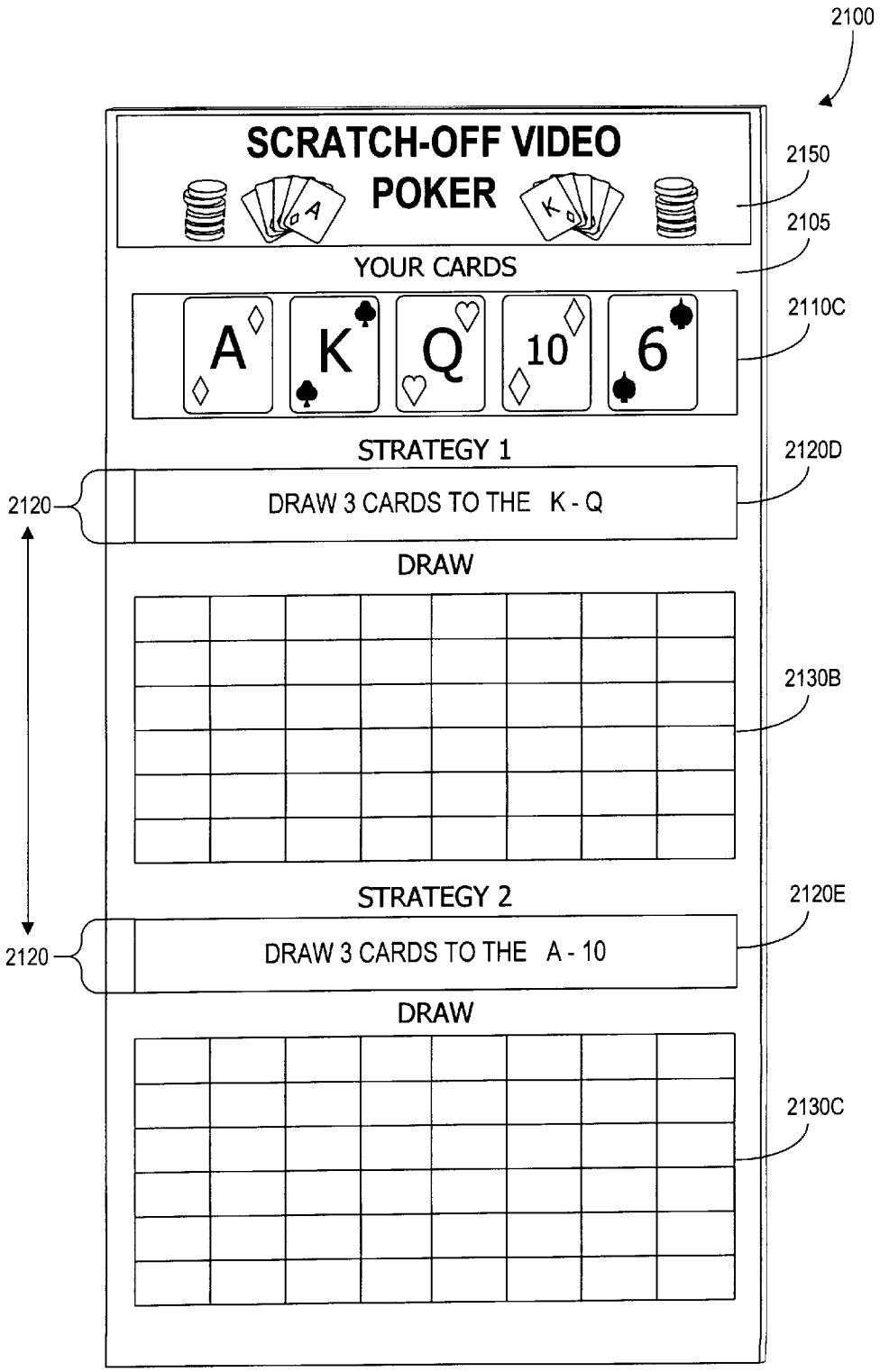
FIG. 8E depicts ticket 2100 after the initial configuration and the strategies have been revealed.

At step 820, the player selects a game strategy from game strategies 2120D–2120E. To do this, the player alters alterable covering surfaces 2120B–2120C (FIG. 8A) to reveal each of the game strategies 2120D–2120E (FIG. 8B). The player then considers revealed game strategies 2120D–2120E and makes a decision as to which strategy to use. FIG. 8E depicts the state of ticket 2100 after step 820 is performed.

Figure 8F:
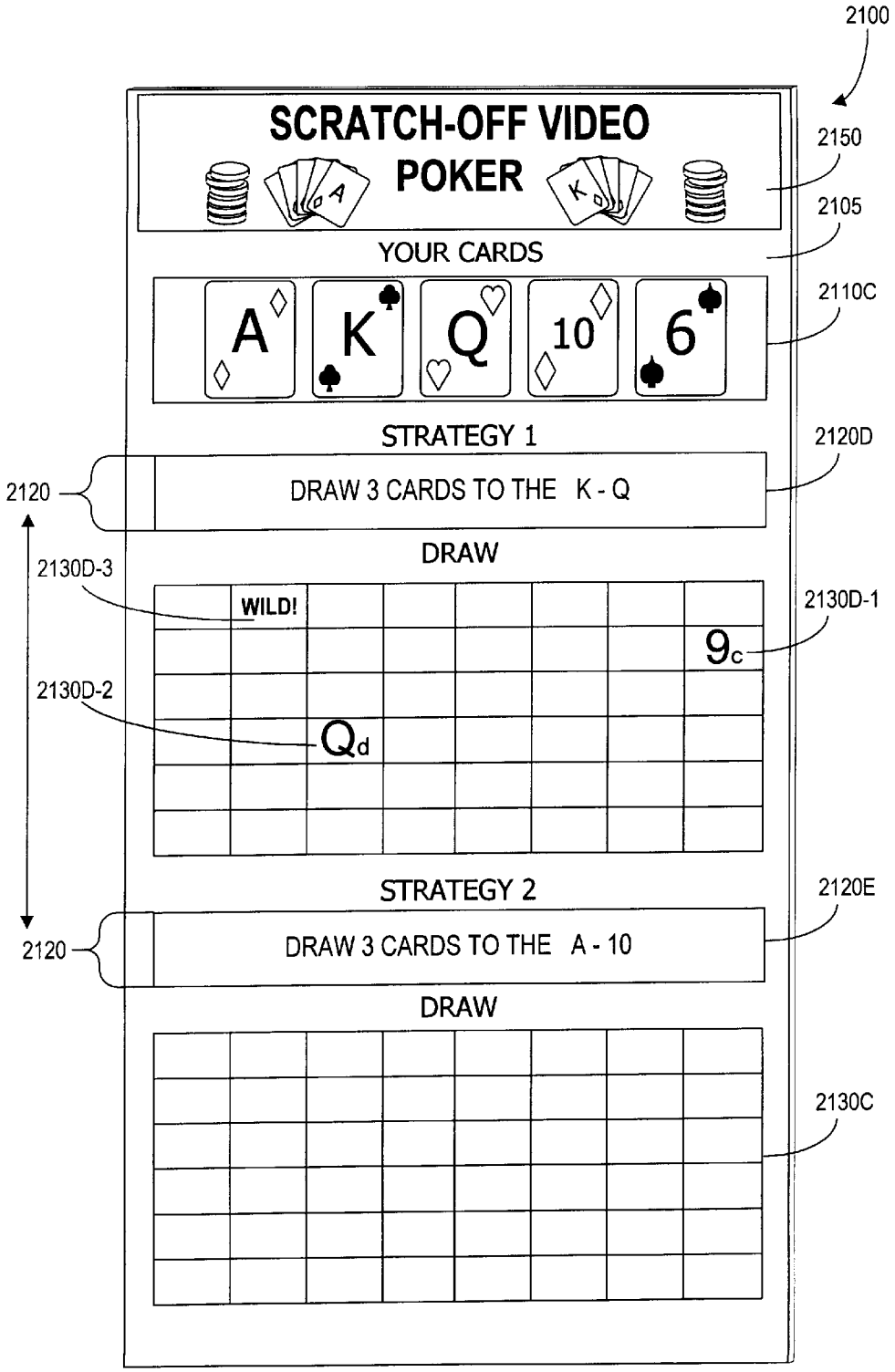
FIG. 8F depicts ticket 2100 after the game has been completed.

At step 830, the player reveals certain draw cards from which the outcome for the game will be determined. To do this, the player alters a portion of either alterable covering surface 2130B or 2130C, depending on the game strategy that he has decided to use. For example, if the player chooses strategy 2120B, then he would alter three of the cells from alterable covering surface 2130B. As shown in FIG. 8F, if the player alters three cells 2130D-1, 2130D-2, and 2130D-3 so that a Nine of clubs (9c), Queen of diamonds (Qd), and a wild card (WILD!) are revealed, the outcome of the game would be Three of a Kind—i.e., Kc-Qh-Qd-WILD!-9c. At this point, process 800 is complete.

Ticket 2100 may be configured to include machine readable indicia, such as bar codes, that are indicative of payouts. Ticket 2100 may also include electrical circuits therein so that payouts may be determined using an electronic verification device, such as the one described above. Further, the strategies 2120D–2120E may be chosen in the same manner as strategies 120E–120G. Still further, process 600 may be used by a player to claim his payout.

Figure 9:
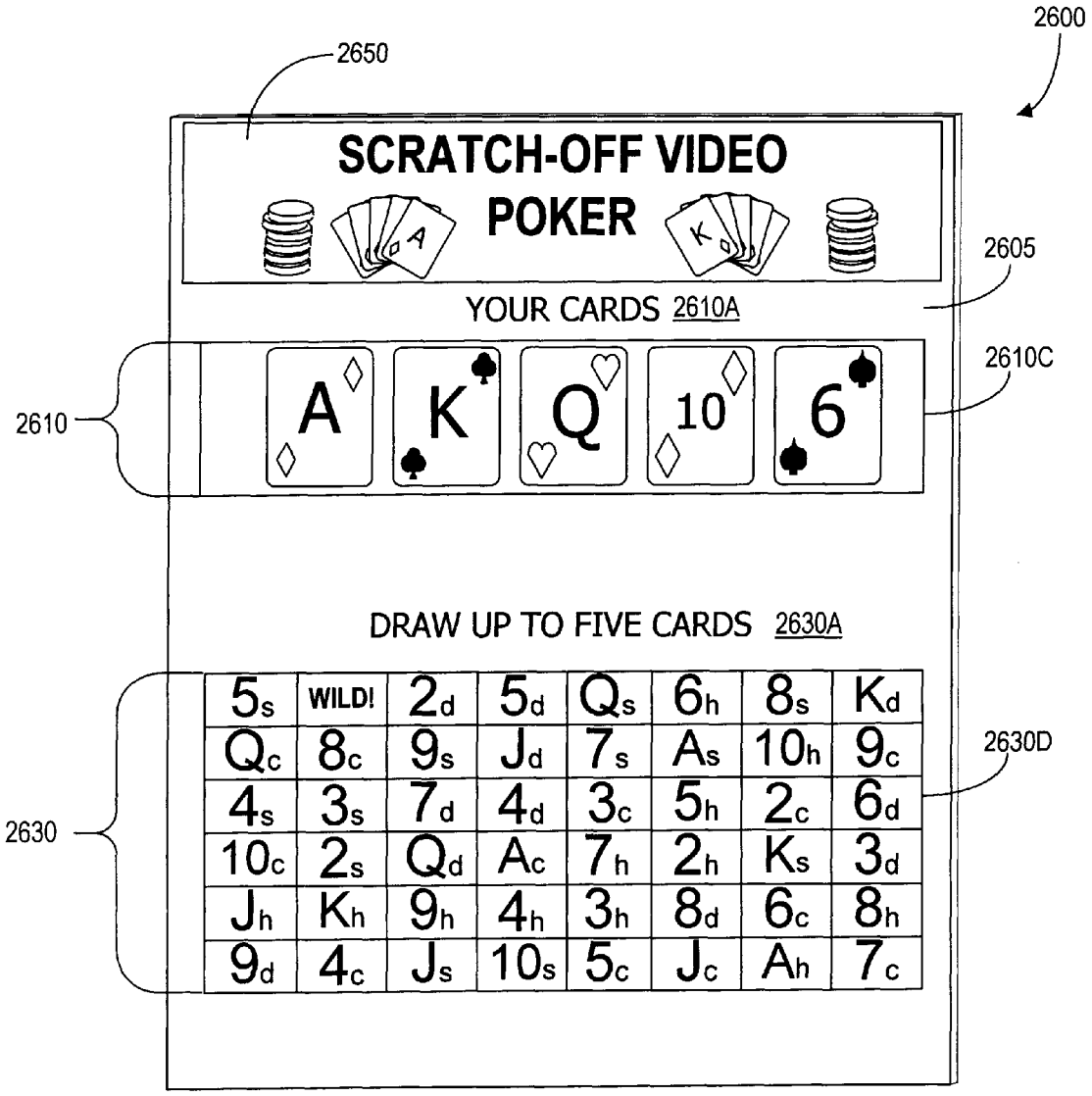
FIG. 9 depicts an alternative embodiment of a ticket 2600 in accordance with the present invention, after all of the alterable covering surfaces have been altered.

Referring next to FIG. 9, an alternate embodiment of an inventive ticket 2600 for an instant lottery game is described. In this embodiment, the game has game indicia associated with it. For example, in the case in which the game simulates computerized video poker, the game indicia include the fifty-two cards that make up a standard deck of playing cards. The game indicia may also include jokers and wildcards.

This embodiment is similar to that of ticket 2100, except that there is no strategy section. The player is presented with an initial hand of cards and then selects the cards that he wants to draw. In FIG. 9, ticket 2600 is depicted after an alterable covering surface (not shown) covering outcome area 2630D has been fully altered.

Ticket 2600 includes a play section 2605 and a background section 2650. Play section 2605 includes an initial configuration section 2610 and an outcome section 2630. Play section 2605 may also include a set of game instructions (not shown) similar to the type described above.

Initial configuration section 2610 is used to indicate an initial configuration for the game, as in ticket 2100. A heading 2610A, such as "YOUR CARDS," may be imprinted on ticket 2600 to indicate initial configuration section 2610. An alterable covering surface may be used to hide initial configuration 2610C, in manner similar to that described above. If used, the alterable covering surface is altered by a player to reveal the initial configuration 2110C. Initial configuration 2610C, in this embodiment, is a subset of cards from a standard deck of fifty-two cards.

Outcome section 2630 includes outcome area 2630D for the game, from which the outcome for the game will be determined. Heading 2630A, such as "DRAW UP TO FIVE CARDS," may be imprinted on ticket 2600 to indicate outcome section 2630. Outcome area 2630 is normally covered by an alterable covering surface (not shown) that is in the form of a grid having a plurality of cells, wherein each cell is defined by a particular row and column. Under each cell is indicia (e.g., a card) such that when a cell is altered, the indicia is revealed. The plurality of indicia located under the cells of the alterable area represent the complement of the subset including the initial configuration.

For example, in this embodiment in which the game indicia include the fifty-two cards in a standard deck of playing cards, the initial configuration includes five of those cards. In this way, the plurality of indicia representing the complement of the cards that make up the initial configuration include forty-seven cards (and may also include wild cards). The forty-seven cards represent those contained in the deck of fifty-two cards, with the exception of the cards shown in initial configuration 2610C. In the present embodiment, the player will draw a number of cards by altering cells of the alterable area to reveal a corresponding number of cards.

In this embodiment, ticket 2600 may include a background section. It may be configured to include information similar to the type described above with reference to background section 150 (FIG. 1).

The instant lottery game using ticket 2600 is played in the same manner as the game described above for ticket 2100—i.e., according to process 800, with the exception that strategies are not used. Additionally, ticket 2600 may be configured to include machine readable indicia, such as bar codes, that are indicative of payouts. Ticket 2600 may also include electrical circuits therein so that payouts may be determined using an electronic verification device, such as the one described above. Still further, process 600 may be used by a player to claim his payout.

Figure 10A:
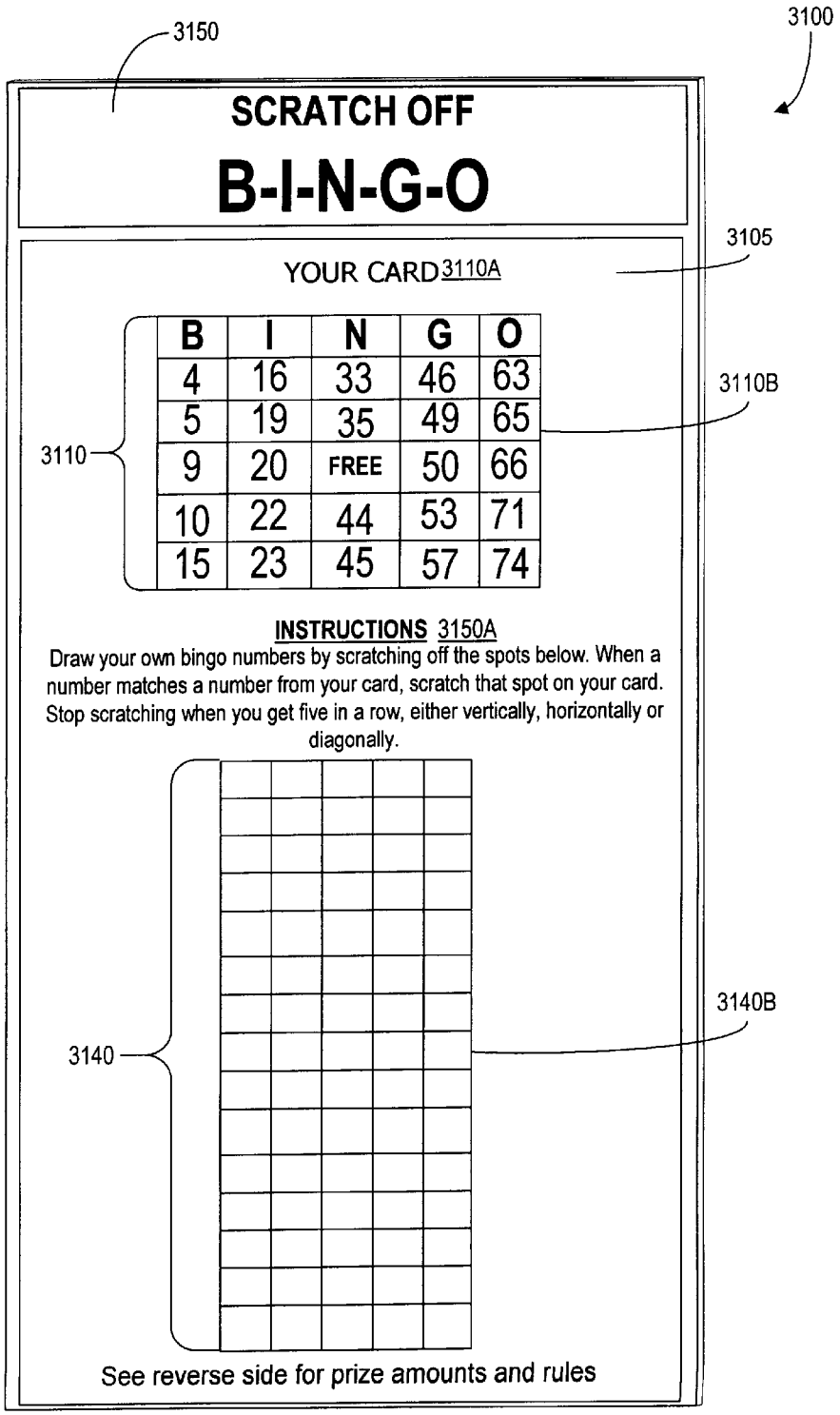
FIG. 10A depicts an alternative embodiment of a ticket 3100 in accordance with the present invention, as it is normally sold to a player.

Referring next to FIGS. 10A and 10B, an alternate embodiment of an inventive ticket 3100 for an instant lottery game is described. In this embodiment, ticket 3100 simulates a game of bingo in which the player wins a payout depending on the number of scratches he requires to obtain five in a row, with fewer scratches resulting in a higher payout. In FIG. 10A, ticket 3100 is depicted as it is normally sold to a player—that is, before the game has been played. The game has game indicia associated with it. In this embodiment, the game indicia include the seventy-five numbers that make up the called numbers from a typical bingo game.

Ticket 3100 includes a play section 3105 and a background section 3150. Play section 3105 includes an initial configuration section 3110 and an outcome section 3140.

Initial configuration section 3110 is used to indicate an initial configuration (or starting point) for the game, and represents the information contained on a conventional bingo card. A heading 3110A, such as "YOUR CARD," may be imprinted on ticket 3100 to indicate initial configuration section 3110. An alterable covering surface 3110B having numbers printed thereon allows the player to track his game progress as described in more detail below. There is no need to hide initial configuration section 3110 since no bingo card is inherently better than any other.

In this exemplary embodiment in which the game simulates bingo, initial configuration 3110 includes a subset of the game indicia—e.g., a card of twenty-four numbers and a free space. Alterable covering surface 3110B may be of the type described above for alterable covering surface 110B (FIG. 1). Thus, as is readily seen, in this embodiment, initial configuration 3110 comprises the player's bingo card. Initial configuration 3110 may be generated at random or produced sequentially.

Outcome section 3140 includes an outcome area 3140C (FIG. 10B) for the game, from which the outcome for the game will be determined. Instructions 3150A may be imprinted on ticket 3100 to indicate the elements of game play.

Alterable covering surface 3140B, which covers outcome area 3140C, is in the form of a grid having a plurality of cells, wherein each cell is defined by a particular row and column. Alterable covering surface 3140B may be of the type described above for the alterable covering surface 110B (FIG. 1). Rather than hiding the complement of the subset including the initial configuration (as in the above poker embodiments), alterable covering surface 3140B hides each of the game indicia—e.g., all seventy-five numbers that may be drawn in the game.

In the present embodiment, the player will draw a number of numbers by altering cells of alterable area 3140B to reveal game numbers. The player continues to draw numbers until he has matched five in a row of his initial configuration 3110.

In this embodiment, ticket 3100 may include a background 3150 section. It may be configured to include information similar to the type described above with reference to background section 150 (FIG. 1).

FIG. 10B depicts ticket 3100 in which alterable covering surface 3130B has been altered. As is seen there, when alterable covering surface 3130B is altered, a plurality of indicia if the form of numbers 3130C are revealed. In this example, the plurality of indicia correspond to each of the game indicia—i.e., the seventy-five numbers which the player is trying to match to the numbers of initial configuration 3110. An outcome for the game will be determined based on the number of cells that a player alters in order to match five numbers in a row.

Figure 10C:
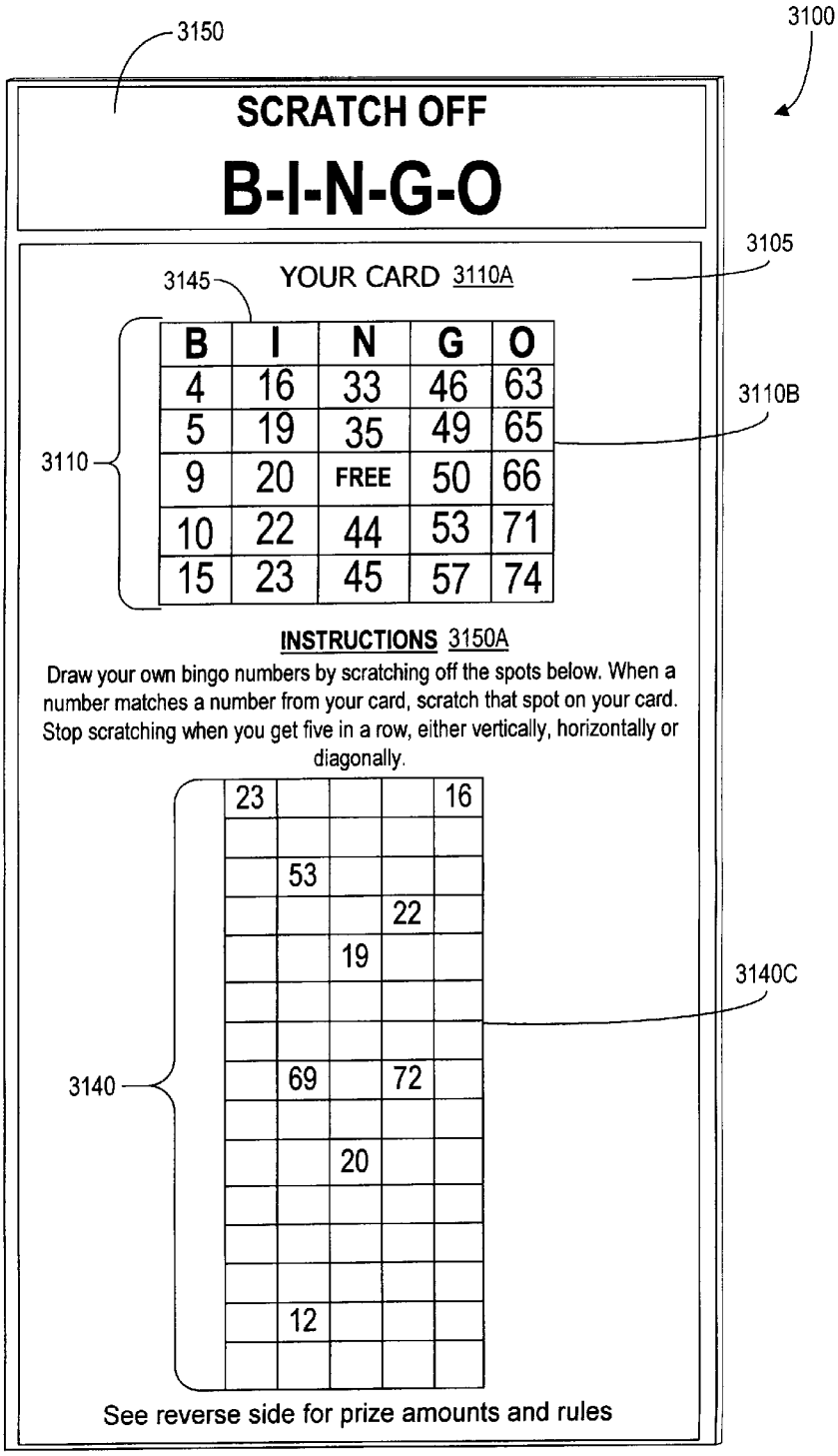
FIG. 10C depicts ticket 3100 after the game has been completed.

FIG. 10C illustrates a ticket 3100 which has been completed by the player. In this example, it is seen that the player has altered nine cells thus revealing nine numbers within outcome area 3140. The numbers "16," "19," "20," "22," and "23" represent numbers that appear within the initial configuration 3110 in a five in a row configuration, specifically all five numbers in the "I" column. The player has also revealed numbers "12," "53," "69," and "72," which numbers do not contribute to his bingo of the "I" column. While the number "53" falls within initial configuration 3110, it plays no part in the bingo of the "I" column.

Since the player has completed a bingo, there is no further need to continue revealing locations from outcome area 3140. At this point, the player determines that nine cells have been altered and refers to the payout information on the back of the ticket 3100 to determine if he has won a payout.

FIG. 10D illustrates the reverse side of ticket 3100, and has a payout area 3150B, a payout redemption instructions area 3150C, and a bar code 3150D. In this embodiment, the payout is determined based on the number of cells that the player alters in order to achieve bingo. Further, as is seen by the payout information area 3150B, the payout to the player decreases as the number of indicia revealed increases. In this example, payout information area 3150B indicates that for a bingo achieved by altering only nine cells, the payout is $500. Those of ordinary skill will appreciate that the payout options could include more levels of payouts, as well as smaller or larger amounts.

Although the particular embodiments shown and described above will prove to be useful in many applications relating to the arts to which the present invention pertains, further modifications of the present invention herein disclosed will occur to persons skilled in the art. All such modifications are deemed to be within the scope and spirit of the present invention as defined by the appended claims.

We claim:

1. A method for playing an instant lottery game using a ticket, comprising the steps of:

determining an initial configuration for the game from the ticket wherein said initial configuration comprises a plurality of indicia;

selecting a game strategy from a plurality of game strategies on the ticket, wherein each of the game strategies has instructions specifying which indicia to discard, thereby drawing new indicia to replace the discarded indicia, and each game strategy is based on the initial configuration, and wherein only a selected number of game strategies and not all possible game strategies are on the ticket, wherein the selected game strategies are those that are most likely to result in a player achieving a favorable outcome for the game; and from a plurality of alterable areas on the ticket each associated with a corresponding one of the plurality of game strategies and each corresponding to one of a plurality of outcomes for the game, altering the alterable area corresponding to the selected game strategy to reveal the corresponding outcome for the game.

2. The method of claim 1, wherein the game comprises a computerized video poker simulation.

3. The method of claim 1, wherein the initial configuration comprises a plurality of cards.

4. The ticket of claim 3, wherein the strategies are those with the highest expected values.

5. The method of claim 1, wherein the step of altering the alterable area comprises the step removing a scratch-off material.

6. The method of claim 5, wherein each of the plurality of game strategies is normally hidden under a corresponding alterable area, and wherein the step of selecting a game strategy comprises the step of altering at least one of the alterable areas to reveal the corresponding game strategy.

7. The method of claim 1, wherein the initial configuration is normally hidden under a corresponding alterable area, and wherein the step of determining the initial configuration comprises the step of altering the alterable area corresponding to the initial configuration to reveal the initial configuration.

8. The method of claim 1, wherein each of the plurality of game strategies is normally hidden under a corresponding alterable area, and wherein the step of selecting a game strategy comprises the step of altering at least one of the alterable areas to reveal the corresponding strategy.

9. The method of claim 1, further comprising the step of determining a payout for the game based on the revealed outcome for the game.

10. The method of claim 1, wherein the ticket further comprises a plurality of payouts for the game, wherein each of the plurality of payouts is associated with a corresponding one of the plurality of outcomes, and wherein the method further comprises the step of altering the alterable area corresponding to the outcome for the game to reveal the payout for the game corresponding thereto.

11. A method for playing an instant lottery game using a ticket, wherein the game has game indicia associated therewith, and wherein the method comprises the steps of:

determining an initial configuration for the game from the ticket, wherein the initial configuration represents a subset of the game indicia;

selecting a game strategy from a plurality of game strategies on the ticket, wherein each of the game strategies has instructions specifying which indicia to discard, thereby drawing new indicia to replace the discarded indicia, and each game strategy is based on the initial configuration, and wherein only a selected number of game strategies and not all possible game strategies are on the ticket, wherein the selected game strategies are those that are most likely to result in a player achieving a favorable outcome for the game; and from a plurality of outcome areas each associated with a corresponding one of the plurality of strategies and each comprising a plurality of indicia representing the complement of the subset with respect to the game indicia and normally hidden under a corresponding alterable area, altering a portion of the alterable area corresponding to the selected game strategy to reveal certain of the indicia so that an outcome for the game can be determined.

12. The method of claim 11, wherein the game comprises a computerized video poker simulation.

13. The method of claim 11, wherein the initial configuration comprises a plurality of cards.

14. The ticket of claim 11, wherein the strategies are those with the highest expected values.

15. The method of claim 11, wherein the step of altering the alterable area corresponding to the selected game strategy comprises the step removing a scratch-off material.

16. The method of claim 11, wherein the initial configuration is normally hidden under a corresponding alterable area, and wherein the step of determining the initial configuration comprises the step of altering the alterable area corresponding to the initial configuration to reveal the initial configuration.

17. The method of claim 16, wherein each of the plurality of game strategies is normally hidden under a corresponding alterable area, and wherein the step of selecting a game strategy comprises the step of altering at least one of the alterable areas to reveal the corresponding game strategy.

18. The method of claim 11, wherein each of the plurality of game strategies is normally hidden under a corresponding alterable area, and wherein the step of selecting a game strategy comprises the step of altering at least one of the alterable areas to reveal the corresponding strategy.

19. The method of claim 11, further comprising the step of determining a payout for the game based on the outcome for the game.

20. The method of claim 19, wherein the ticket comprises a payout table indicative of payouts for the game, and wherein the step of determining the payout comprises the step of comparing the outcome for the game to the payout table.

21. A method for playing an instant lottery game using a ticket, wherein the game has game indicia associated therewith, and wherein the method comprises the steps of:

determining an initial configuration for the game, wherein the initial configuration comprises a plurality of initial indicia representing a subset of the game indicia; and selecting a strategy included on the ticket to indicate discarding of at least one of the initial indicia;

altering a portion of an alterable covering surface normally hiding final indicia representing the complement of the subset with respect to the game indicia to reveal a predetermined number of the final indicia so that an outcome for the game can be determined.

22. The method of claim 21, wherein the game comprises a computerized video poker simulation.

23. The method of claim 22, wherein the game indicia comprise a deck of playing cards.

24. The method of claim 23, wherein the initial indicia comprise a first plurality of cards selected from the deck.

25. The method of claim 24, wherein the final indicia comprise a second plurality of cards from the deck with the exception of the first plurality of cards.

26. The method of claim 22, wherein the initial indicia are normally hidden under an alterable area, and wherein the step of determining the initial configuration comprises the step of altering the alterable area corresponding to the initial indicia to reveal the initial indicia.

27. The method of claim 21, further comprising the step of determining the outcome for the game based on the initial indicia and the revealed final indicia.

28. The method of claim 21, further comprising a payout table for determining a payout for the outcome of the game.

29. The method of claim 21, wherein the ticket comprises an electrical circuit associated with the final indicia, further comprising the step of determining the outcome for the game comprises the step of causing a machine to read the electrical circuit to determine a payout for the game.

* * * * *